US011447905B2

(12) United States Patent
Lee et al.

(10) Patent No.: US 11,447,905 B2
(45) Date of Patent: Sep. 20, 2022

(54) CLOTHING MANAGEMENT APPARATUS AND METHOD FOR CONTROLLING THEREOF

(71) Applicant: SAMSUNG ELECTRONICS CO., LTD., Suwon-si (KR)

(72) Inventors: Jungmin Lee, Suwon-si (KR); Minjeong Kang, Suwon-si (KR); Yoonhee Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 449 days.

(21) Appl. No.: 16/719,227

(22) Filed: Dec. 18, 2019

(65) Prior Publication Data

US 2020/0208319 A1 Jul. 2, 2020

(30) Foreign Application Priority Data

Dec. 31, 2018 (KR) ..... 10-2018-0174169

(51) Int. Cl.

| | |
|---|---|
| ***D06F 33/00*** | (2020.01) |
| ***D06F 34/18*** | (2020.01) |
| ***D06F 34/28*** | (2020.01) |
| *D06F 103/06* | (2020.01) |

(52) U.S. Cl.

CPC ..... *D06F 33/00* (2013.01); *D06F 34/18* (2020.02); *D06F 34/28* (2020.02); *D06F 2103/06* (2020.02)

(58) Field of Classification Search

CPC ..... D06F 33/00; D06F 34/18; D06F 34/28; D06F 2103/06

See application file for complete search history.

(56) References Cited

U.S. PATENT DOCUMENTS

| | | | | |
|---|---|---|---|---|
| 7,971,777 | B2 | 7/2011 | Ha | |
| 10,174,452 | B2 * | 1/2019 | Choi | D06F 58/10 |
| 10,563,338 | B2 | 2/2020 | Chen et al. | |
| 10,712,922 | B2 * | 7/2020 | Schultz | G06F 3/04845 |

(Continued)

FOREIGN PATENT DOCUMENTS

| | | | |
|---|---|---|---|
| EP | 3252226 | A1 | 12/2017 |
| EP | 3269864 | A1 | 1/2018 |

(Continued)

OTHER PUBLICATIONS

International Search Report dated Oct. 11, 2019 issued by the International Searching Authority in counterpart Application No. PCT/KR2019/008475 (PCT/ISA/210).

(Continued)

*Primary Examiner* — Justin S Lee

(74) *Attorney, Agent, or Firm* — Sughrue Mion, PLLC

(57) ABSTRACT

A clothing management apparatus may include a display and a processor to, based on a state of a garment in an image of the garment, determine a management necessity of the garment, based on the management necessity, determine a management completeness that is expected when the garment is managed according to a management mode among a plurality of management modes, based on the management completeness, generate an expected image of the garment when the garment is managed according to the management mode, and control the display to display the expected image to a user.

18 Claims, 22 Drawing Sheets

(56) References Cited

U.S. PATENT DOCUMENTS

| | | | | |
|---|---|---|---|---|
| 10,753,029 | B2 | 8/2020 | Shu et al. | |
| 11,313,072 | B2 * | 4/2022 | Sights | A41H 3/007 |
| 2009/0119848 | A1 | 5/2009 | Kim et al. | |
| 2010/0236296 | A1 | 9/2010 | Choi et al. | |
| 2012/0090099 | A1 | 4/2012 | Kim et al. | |
| 2014/0018962 | A1 * | 1/2014 | Jung | D06F 34/28 700/275 |
| 2017/0350067 | A1 * | 12/2017 | Choi | D06F 73/02 |
| 2018/0044834 | A1 | 2/2018 | Shu et al. | |
| 2018/0060937 | A1 * | 3/2018 | Shu | D06F 34/28 |
| 2018/0127910 | A1 | 5/2018 | Xu et al. | |
| 2018/0165736 | A1 | 6/2018 | Love et al. | |
| 2018/0218433 | A1 | 8/2018 | Penner et al. | |
| 2018/0363210 | A1 | 12/2018 | Shu et al. | |
| 2019/0169780 | A1 * | 6/2019 | Chen | G05B 13/0285 |
| 2019/0382941 | A1 * | 12/2019 | Hwang | G06T 5/50 |
| 2019/0385017 | A1 * | 12/2019 | Hwang | G06N 3/08 |
| 2020/0018006 | A1 * | 1/2020 | So | H04N 5/247 |
| 2020/0096954 | A1 * | 3/2020 | Kim | D06F 33/00 |
| 2020/0184127 | A1 * | 6/2020 | Bell | G06F 30/20 |
| 2021/0297278 | A1 * | 9/2021 | Lee | G06K 7/10366 |

FOREIGN PATENT DOCUMENTS

| | | | |
|---|---|---|---|
| EP | 3 290 560 | A1 | 3/2018 |
| EP | 3293299 | A1 | 3/2018 |
| EP | 3396057 | A1 | 10/2018 |
| JP | 2003-345872 | A | 12/2003 |
| JP | 4021149 | B2 | 12/2007 |
| JP | 2008-287348 | A | 11/2008 |
| JP | 2017-113419 | A | 6/2017 |
| JP | 2018-194886 | A | 12/2018 |
| KR | 10-2006-0117524 | A | 11/2006 |
| KR | 10-2007-0036437 | A | 4/2007 |
| KR | 10-2008-0109509 | A | 12/2008 |
| KR | 10-2009-0017826 | A | 2/2009 |
| KR | 10-2012-0038271 | A | 4/2012 |
| KR | 101151428 | B1 | 6/2012 |
| KR | 10-2013-0109721 | A | 10/2013 |
| KR | 10-1362376 | B1 | 2/2014 |
| KR | 10-2014-0073197 | A | 6/2014 |
| KR | 10-2015-0066695 | A | 6/2015 |
| KR | 10-1520655 | B1 | 6/2015 |
| KR | 10-2017-0122774 | A | 11/2017 |
| KR | 10-2017-0137505 | A | 12/2017 |
| KR | 10-2017-0138559 | A | 12/2017 |
| KR | 102201382 | B1 | 1/2021 |
| WO | 2018219330 | A1 | 12/2018 |

OTHER PUBLICATIONS

Written Opinion dated Oct. 11, 2019 issued by the International Searching Authority in counterpart Application No. PCT/KR2019/008475 (PCT/ISA/237).

Communication dated Sep. 21, 2021 issued by the European Patent Office in European Application No. 19907179.6.

Written Opinion (PCT/ISA/237) issued by the International Searching Authority in corresponding International Application No. PCT/KR2019/018116, dated Apr. 13, 2020.

International Search Report (PCT/ISA/210), issued by International Searching Authority in corresponding International Application No. PCT/KR2019/018116, dated Apr. 13, 2020.

* cited by examiner

FIG. 6

| MATTER NAME | Matter Name | FABRIC_NAME | FABRIC_PRIORITY | AVAIL_COURSE |
|---|---|---|---|---|
| SILK | | silk | 1 | 13 |
| NATURAL LEATHER | Leather | fur_Leather | 2 | 19 |
| COATED LEATHER | Coated Leather | | | |
| SYNTHETIC LEATHER | Synthetic Leather | | | |
| NATURAL FUR | Natural fur | | | |
| POLYVINYL CHLORIDE | Polyvinyl chloride | delicate | 3 | 1, 2, 3, 4, 5, 6, 7, 8, 9, 10, 11, 12, 13, 14, 15, 16, 17, 18, 20, 21, 22, 23, 24 |
| LINEN | | | | |
| LINEN (FLAX) | | | | |
| FUR | | | | |
| MOHAIR | mohair | | | |
| CASHMERE | Cashmere | | | |
| ANGORA | Angora | | | |
| ALPACA | Alpaca | | | |
| FEATHER | Feather | | | |
| DOWN | Down | | | |
| POLYURETHANE | Polyurethane | | | |
| NATURAL RUBBER | Natural rubber | | | |
| SYNTHETIC RUBBER | Synthetic rubber | | | |
| METAL FIBER | Metal fiber | | | |
| METALLIC FIBER (NOT DESIGNATED) | Metallic fiber | | | |
| RAYON (VISCOSE) | Rayon | | | |
| CUPRA | Cupra | | | |
| MODAL | Modal | | | |
| RIO CELL | Rio Cell | | | |
| CELLULOSE FIBER (NOT DESIGNATED) | Cellulose fiber | | | |
| NYLON | Nylon | normal | 4 | 1, 2, 3, 4, 5, 6, 7, 8, 9, 10, 12, 13, 14, 15 16, 17, 18, 20, 21 22, 23, 24, 25 |
| POLYMETHYL METHACRYLATE | Polymethyl methacrylate | | | |
| POLYESTER | Polyester | | | |
| ACRYL | Acryl | | | |
| ACETATE | Acetate | | | |
| TRIACETATE | Triacetate | | | |
| COTTON | Cotton | | | |

FIG. 7
GARMENT 1
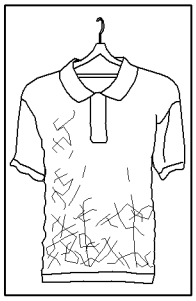
GARMENT 2
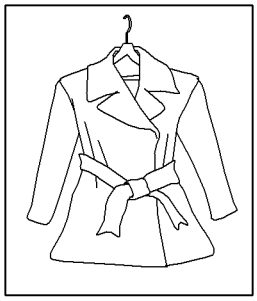
| MANAGEMENT NECESSITY (%) / MANAGEMENT COMPLETENESS(%) | 100 | 90 |
|---|---|---|
| MANAGEMENT COMPLETENESS IN MANAGEMENT MODE A | 50 | 60 |
| MANAGEMENT COMPLETENESS IN MANAGEMENT MODE B | 80 | 90 |
| MANAGEMENT COMPLETENESS IN MANAGEMENT MODE C | 100 | - |

FIG. 13A

| | MANAGEMENT MODE A<br>POWER CONSUMPTION: 100kWh<br>TIME SPENT: 60MINUTES | MANAGEMENT MODE B<br>POWER CONSUMPTION: 80kWh<br>TIME SPENT: 40MINUTES | MANAGEMENT MODE C<br>POWER CONSUMPTION: 150kWh<br>TIME SPENT: 90MINUTES |
|---|---|---|---|
| GARMENT 1 | O | X | X |
| GARMENT 2 | O | X | X |
| GARMENT 3 | X | X | O |

FIG. 14A

| | MANAGEMENT MODE A POWER CONSUMPTION: 100kWh TIME SPENT: 60MINUTES | MANAGEMENT MODE B POWER CONSUMPTION: 80kWh TIME SPENT: 40MINUTES | MANAGEMENT MODE C POWER CONSUMPTION: 150kWh TIME SPENT: 90MINUTES |
|---|---|---|---|
| GARMENT 1 | O | O | X |
| GARMENT 2 | O | O | O |
| GARMENT 3 | O | X | O |

FIG. 14B

| | MANAGEMENT MODE A POWER CONSUMPTION: 100kWh TIME SPENT: 60MINUTES | MANAGEMENT MODE B POWER CONSUMPTION: 80kWh TIME SPENT: 40MINUTES | MANAGEMENT MODE C POWER CONSUMPTION: 150kWh TIME SPENT: 90MINUTES |
|---|---|---|---|
| GARMENT 1 | MANAGEMENT COMPLETENESS: 100% | MANAGEMENT COMPLETENESS: 80% | X |
| GARMENT 2 | MANAGEMENT COMPLETENESS: 70% | MANAGEMENT COMPLETENESS: 50% | MANAGEMENT COMPLETENESS: 100% |
| GARMENT 3 | MANAGEMENT COMPLETENESS: 90% | X | MANAGEMENT COMPLETENESS: 100% |

CLOTHING MANAGEMENT APPARATUS AND METHOD FOR CONTROLLING THEREOF

CROSS-REFERENCE TO RELATED APPLICATION(S)

This application is based on and claims priority under 35 U.S.C. § 119 to Korean Patent Application No. 10-2018-0174169, filed on Dec. 31, 2018, in the Korean Intellectual Property Office, the disclosure of which is incorporated by reference herein in its entirety.

BACKGROUND

1. Field

The disclosure relates to a clothing management apparatus and a method for controlling the same and, more particularly, to a clothing management apparatus that performs a function, such as removing wrinkles and odors from a garment, or the like.

2. Description of the Related Art

Recently, a clothing management apparatus which performs a function of removing wrinkles of a garment, removing food smells on the garment, or the like, has been developed.

In general, a clothing management apparatus determines an optimal management mode for managing a garment according to a type of a garment, for example, a school uniform, a dress, a suit, or the like, and manages the garment according to the determined management mode.

In some situations, a user may wish to manage a garment according to various criteria, such as time or power consumption, rather than manage a garment at an optimal management mode in which a large amount of time or power may be consumed.

SUMMARY

Embodiments herein may overcome the above disadvantages and other disadvantages not described above.

The disclosure has been made for the above-described necessity, and an objective of the disclosure is to provide a clothing management apparatus that assigns a user with a choice of management mode by providing a user with information about a plurality of management modes applicable to a garment, and a controlling method thereof.

According to an embodiment, there is provided a clothing management apparatus. The clothing management apparatus may include a display and a processor configured to, based on a state of a garment in an image of the garment, determine a management necessity of the garment, based on the management necessity, determine a management completeness that is expected when the garment is managed according to a management mode among a plurality of management modes, based on the management completeness, generate an expected image of the garment when the garment is managed according to the management mode, and control the display to display the expected image to a user.

The processor may be further configured to, based on information of fabric of the garment, determine the management mode among the plurality of management modes, predict the management completeness of the garment that is expected when the garment is managed in a first management mode and a second management mode, generate a first expected image of the garment managed in the first management mode and a second expected image of the garment managed in the second management mode, and control the display to display the first and second expected images and information on the first and second management modes on the display, and based on a user command selecting one of the first and second management modes being input, manage the garment in the selected management mode.

The information on the first and second management modes may include information on management completeness of the garment that is predicted in the first and second management modes.

The information on the first and second management modes may include information on power consumption of the clothing management apparatus that is expected when the garment is managed in the first and second management modes.

The information on the first and second management modes may include information on expected times for managing the garment in the first and second management modes.

The processor may be further configured to, based on a plurality of images including each of a plurality of garments, determine the management mode that is applicable to each of the plurality of garments based on fabric information of each of the plurality of garments, classify the plurality of garments into groups based on the determined management mode, and control the display to display information on the management mode that is determined by the classified groups.

The processor may be further configured to classify the garment, among the plurality of garments, into one of the groups to which a same management mode is applied, and control the display to display information on the determined management mode by the classified groups.

The processor may be further configured to predict management completeness of each of the plurality of garments that is expected when the plurality of garments are managed by each of the applicable management mode, and classify the plurality of garments so that the plurality of garments are managed with a relatively high management completeness.

The processor may be further configured to determine power consumption of the clothing management apparatus that is expected when the plurality of garments are managed in each of the applicable management modes, and classify the plurality of garments so that the plurality of garments are managed with a relatively low power consumption, and determine an expected time for managing the plurality of garments in each of the applicable management mode, and classify the plurality of garments so that the plurality of garments are managed in a relatively short time.

The processor may be further configured to classify the plurality of garments so that the plurality of garments are managed in a minimum number of times to satisfy the management completeness input by the user.

The processor may be further configured to classify the plurality of garments by a thickness of each of the plurality of garments.

The processor may be further configured to classify the plurality of garments based on a plurality of different criteria and control the display to display information on the management modes that are applicable to each of the plurality of garments for each criterion.

The processor may be further configured to classify the plurality of garments so that the plurality of garments are managed with a relatively higher management completeness, or classify the plurality of garments so that the plurality of garments are managed in a relatively shorter time.

The processor may be further configured to control the display to display a user interface UI for receiving a user command to set a classification criterion of the plurality of garments, and based on the user command being received through the UI, classify the plurality of garments based on the criterion.

The processor may be further configured to determine the management necessity of the garment included in the obtained image with the obtained image as input data to a first artificial intelligence AI model that is trained to determine the management necessity of the garment based on state information of the garment, determine the management completeness using a second AI model that is trained to predict the management completeness of the garment when the garment is managed according to the management mode based on the management necessity of the garment, and generate the expected image of the garment that is expected when the garment is managed according to the management mode, using a third AI model that is trained to generate the expected image of the garment based on the management completeness.

According to another embodiment, there is provided a controlling method of a clothing management apparatus. The method may include, based on a state of a garment in an image of the garment, determining a management necessity of the garment; based on the management necessity, determining a management completeness that is expected when the garment is managed according to a management mode among a plurality of management modes; based on the management completeness, generating an expected image of the garment when the garment is managed according to the management mode; and displaying the expected image to a user.

The controlling method may further include, based on information of fabric of the garment, determining the management mode among the plurality of management modes, predicting the management completeness of the garment that is expected when the garment is managed in a first management mode and a second management mode, generating a first expected image of the garment managed in the first management mode and a second expected image of the garment managed in the second management mode, and displaying the first and second expected images and information on the first and second management modes on the display, and based on a user command selecting one of the first and second management modes being input, managing the garment in the selected management mode.

The information on the first and second management modes may include information on management completeness of the garment that is predicted in the first and second management modes.

The information on the first and second management modes may include information on power consumption of the clothing management apparatus that is expected when the garment is managed in the first and second management modes.

The information on the first and second management modes may include information on expected times for managing the garment by the first and second management modes.

According to various embodiments as described herein, by displaying information on the expected time for management of a garment with the image of the garment that is expected when the clothing management for each management mode is completed, the user may actively determine the management mode of the clothing management apparatus depending on the user's situation.

In addition, when the management of a plurality of garments is required, by classifying the garments that may be managed in the same management mode and displaying information to guide the management of the plurality of garments for each classified group, the user may efficiently use the clothing management apparatus.

BRIEF DESCRIPTION OF THE DRAWINGS

The above and other aspects, features, and advantages of certain embodiments of the disclosure will be more apparent from the following description taken in conjunction with the accompanying drawings, in which:

FIG. 6 is a diagram for determining a management mode applicable to a garment according to an embodiment;

FIG. 7 is a diagram illustrating a method for determining management completeness of a garment expected when the garment is managed by the clothing management apparatus according to an embodiment;

FIG. 13A is a chart showing a management mode applicable to each of the plurality of garments according to an embodiment;

FIG. 14A is a chart showing a plurality of management modes applicable to a garment according to an embodiment;

FIG. 14B is a chart showing information on the applicable management mode according to an embodiment;

DETAILED DESCRIPTION

The terms used in embodiments of the disclosure are terms that are widely used in consideration of functions in the disclosure, but may be changed depending on the intention of those skilled in the art or a judicial precedent, the emergence of a new technique, and the like. In addition, some terms may be arbitrarily chosen by an applicant. As such, the meaning of such terms will be explained in detail in a corresponding portion of the disclosure. Therefore, the terms used in embodiments of the disclosure may be defined on the basis of the meaning of the terms and the contents throughout the disclosure.

A detailed description of conventional techniques related to the disclosure that may unnecessarily obscure the gist of the disclosure will be shortened or omitted.

Embodiments of the disclosure will be described in detail with reference to the accompanying drawings, but the disclosure is not limited to embodiments described herein.

Figure 1:
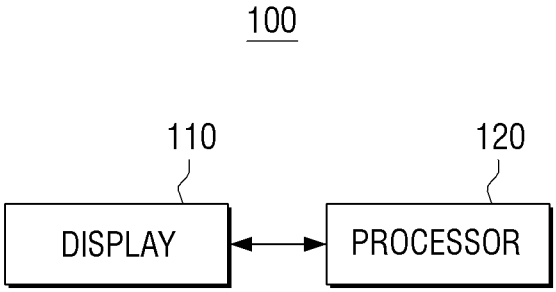
FIG. 1 is a block diagram of a clothing management apparatus according to an embodiment.

FIG. 1 is a block diagram of a clothing management apparatus according to an embodiment.

Referring to FIG. 1, a clothing management apparatus 100 may include a display 110 and a processor 120.

The display 110 may display various screens. For example, the display 110 may display information associated with various functions provided by the clothing management apparatus 100 and a user interface (UI) for interaction with the user. In addition, the display 100 may display information regarding the management mode applicable to the garment to be managed and an estimated image of the garment during or after the management by the clothing management apparatus 100 has been completed. Here, the clothing management may include any type of cleaning, washing, steaming, dry cleaning, laundering, pressing and the like. However, the clothing management is not limited thereto.

The display 110 may be implemented as various formats, such as a liquid crystal display (LCD), a plasma display panel (PDP), a light emitting diode (LED), an organic light emitting diode (OLED), or the like.

The display 110 may be coupled with a touch sensor and implemented as a touch screen.

The display 110 may be disposed on one area of a door of the clothing management apparatus 100, but is not limited thereto.

The processor 120 may control overall operations of the clothing management apparatus 100. The processor 120 may include one or more of a central processing unit (CPU), an application processor (AP), or a communication processor (CP).

The processor 120, when an image including the garment is obtained, may determine management necessity for the garment based on a state information of the garment, and determine expected management completeness when the garment is managed in a specific management mode based on the management necessity. Here, the state information may refer to any information related to a state of the garment prior to performing the clothing management. For example, the state information may include amount of dust, wrinkles, stains, spots, and others, to determine how much treatment is needed for the garment. However, the state information is not limited hereto.

Based on the management completeness, the processor 120 may generate an expected image of the garment when the clothing management is completed, and display the generated image through the display 110.

Accordingly, a user may be presented with visual feedback regarding the degree of clothing management.

A specific operation of the processor 120 controlling operations of the garment management apparatus 100 will be further described with reference to FIGS. 4 to 14E.

Figure 2:
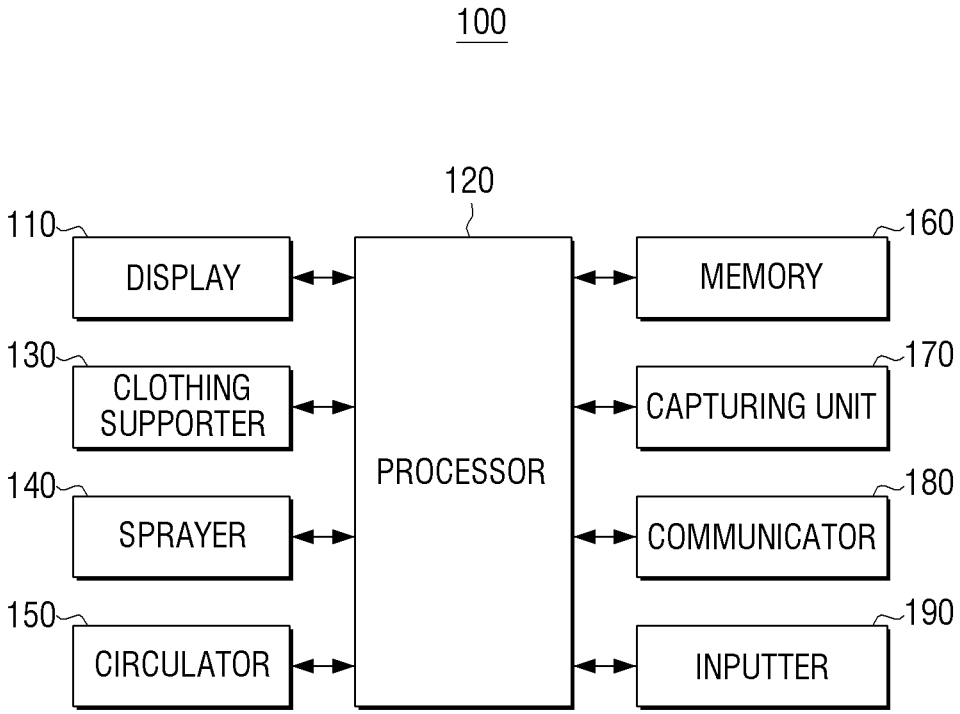
FIG. 2 is a detailed block diagram of a clothing management apparatus according to an embodiment.

FIG. 2 is a detailed block diagram of a clothing management apparatus according to an embodiment.

Referring to FIG. 2, the clothing management apparatus 100 may include a display 110, a clothing supporter 130, a sprayer 140, a circulator 150, a memory 160, a capturing unit 170, a communicator 180, an inputter 190, and the processor 120.

The clothing supporter 120, disposed inside the clothing management apparatus 100 for accommodating the garment, may support or fix the garment. The clothing management apparatus 100 may include an accommodating space and the clothing supporter 120 may be separated from the accommodating space, and may be disposed again in the accommodating space based on a state of supporting the garment.

The sprayer 140 may spray steam or air to the garment in the accommodating space. Specifically, the sprayer 140 may spray high-temperature steam to soften fiber structure of the garment, or spray compressed air to the garment to relieve wrinkles of the garment, or to remove dust or the like from the garment. Here, the sprayer 140 is a device for spraying a liquid or any chemical, and may be in the form of a valve, a nozzle, a pump, and others, however, the sprayer 140 is not limited hereto.

The sprayer 140 may be installed to be movable upward or downward in the accommodating space, and as such, the sprayer 140 may spray steam or air while moving upward or downward of the accommodating space.

The circulator 150 may circulate air in the accommodating space. Specifically, the circulator 150 may circulate air in the accommodating space by introducing high-temperature air into the accommodating space and inhaling air introduced to the accommodating space again.

By circulating high-temperature air in the accommodating space, the circulator 150 may keep a fiber structure of the garment to be a softened state and dry clothing.

The circulator 150 may be disposed at a lower portion of the accommodating space, but is not limited thereto.

The memory 160 may store various data for driving the clothing management apparatus 100. Specifically, the memory 160 may store instructions, data, an application program for driving the clothing management apparatus 100.

The memory 160 may include one or more of a volatile memory or non-volatile memory. The volatile memory may include dynamic random access memory (DRAM), static RAM (SRAM), synchronous DRAM (SDRAM), phase-change RAM (PRAM), magnetic RAM (MRAM), resistive RAM (RRAM), ferroelectric RAM (FeRAM), or the like. The non-volatile memory may include read only memory (ROM), programmable ROM (PROM), electrically programmable ROM (EPROM), electrically erasable programmable ROM (EEPROM), flash memory, or the like.

The memory 160 may store information associated with the management mode of the clothing management apparatus 100. For example, the memory 160 may store information of a standard mode, a fine dust removal mode to remove fine dust, a quick mode to quickly perform clothing management, a sterilization mode to remove germ, a dry mode to remove moisture, or the like.

The memory 160 may store information on an operation of the sprayer 140, the circulator 150, or the like, by management modes of the clothing management apparatus 100. For example, the memory 160 may store information on an operation of the sprayer 140 that is set to spray high-pressured steam in the sterilization mode, and store information on an operation of the circulator 150 that is set to introduce and inhale air into the accommodating space in the fine dust removal mode.

The memory 160 may store a trained artificial intelligence (AI) model. Specifically, the memory 160 may store a first AI model that may be trained to determine the management necessity of the garment based on state information of the garment, a second AI model that may be trained to determine expected management completeness of the clothing management in the case of managing the garment in a specific management mode, based on the management necessity, and a third AI model that may be trained to generate an expected image of the garment when the clothing management is completed, based on the management completeness.

The camera 170 may generate an image by photographing an object. For example, the camera 170 may generate an image including the garment by photographing the garment.

The camera 170 may be disposed at the door of the clothing management apparatus 100, but is not limited thereto. For example, the camera 170 may be disposed inside of the accommodating space.

An image including the garment photographed by the camera 170 may be stored in the memory 160.

The communicator 180 may transmit and receive various data by communicating with an external device. For example, the communicator 180 may communicate with an external device through local area network (LAN) and Internet network, and communicate with an external device through various communication methods, such as Bluetooth (BT), Bluetooth Low Energy (BLE), Wireless Fidelity (WI-FI), Zigbee, or the like.

The inputter 190 may be a user interface configured to receive a user command. For example, the inputter 190 may receive a user command to select a specific management mode.

The inputter 190 may be implemented as a button, but is not limited thereto. For example, when the display 110 is coupled with a touch sensor and implemented as a touch screen, the inputter 190 may be a touch screen.

The processor 120 may perform control of each configuration of the clothing management apparatus 100 described above. Specifically, when a user command to select a specific management mode is input, the processor 120 may perform control for each configuration of the clothing management apparatus 100 for managing the garment according to the management mode.

For example, the processor 120, based on a user command, may control an operation of the sprayer 140 if performing a steam function is necessary, and if performing a dry function is necessary, the processor 120 may control an operation of the sprayer 140.

Figure 3:
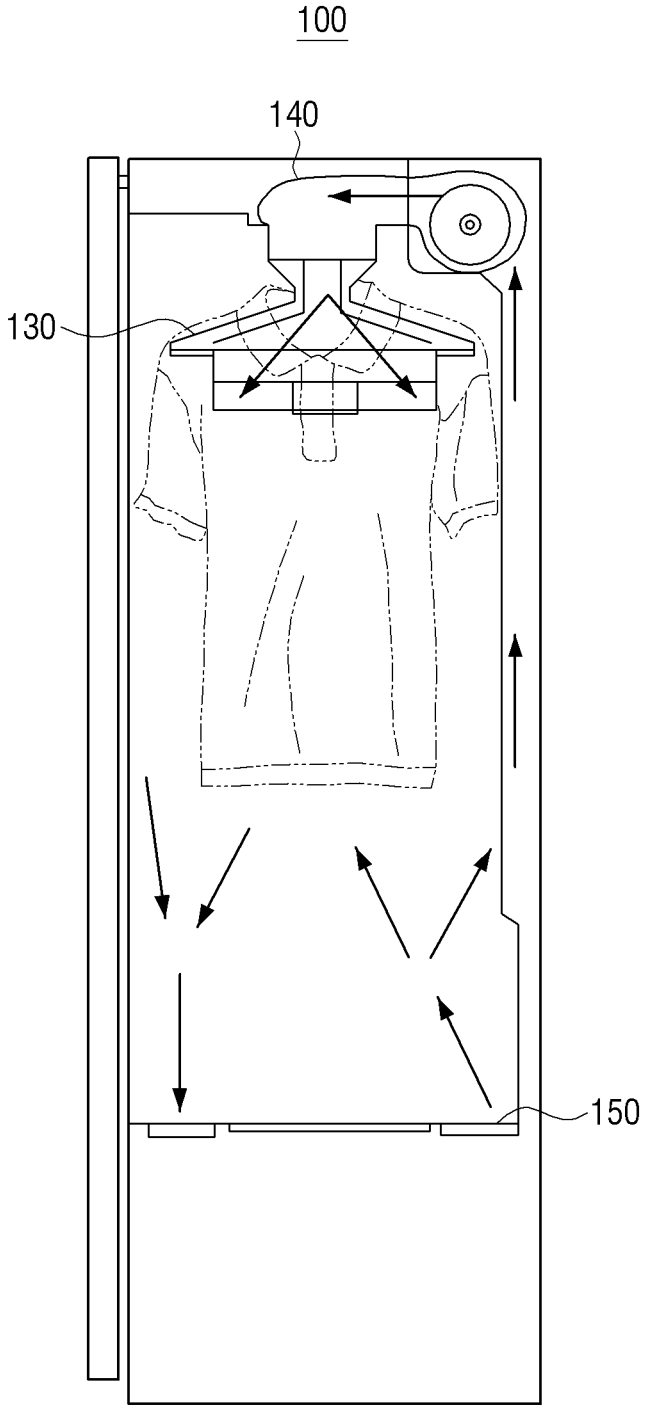
FIG. 3 is a schematic diagram of a clothing management apparatus according to an embodiment.

FIG. 3 is a schematic diagram of a clothing management apparatus according to an embodiment.

The clothing management apparatus 100 may manage the garment supported by the clothing supporter 130 using the sprayer 140 and the circulator 150. For example, the clothing management apparatus 100 may perform a clothing management operation in an order of heating, steaming, drying, dust removing using the sprayer 140 and the circulator 150.

Here, the heating function is to soften the fiber structure of clothing by introducing high-temperature air inside the accommodating space using the circulator 150 disposed at a lower portion of the accommodating space. As the fiber structure of the garment is softened, the subsequent steam function may more effective.

The steam function is a function of applying pressure to the front and rear surfaces of the garment by spraying high-temperature steam or compressed air to the clothing using the sprayer 140. This may result in compression of the clothing. The sprayer 140 may be disposed on a side of the accommodating space and spray steam or compressed air to the garment while moving upward or downward.

As illustrated in FIG. 3, when the sprayer 140 is connected to the clothing supporter 130, the steam sprayed by the sprayer 140 may touch the garment hung by the clothing supporter 130 via the clothing supporter 130, and the garment may be compressed therethrough.

The dry function is a function to remove moisture remaining in the garment by introducing high-temperature air into the accommodating space using the circulator 150. Alternatively, the circulator 150 may also remove moisture remaining in the garment by introducing low-temperature air.

The dust removal function is to remove dust on the garment hung by the clothing supporter 130, by rapidly moving the clothing supporter 130 in a left and right direction or a front and back direction.

The dust removal function may be implemented such that, when the sprayer 140 is connected to the clothing supporter 130, dust is removed by high pressure air sprayed from the sprayer 140 touching the garment hung by the clothing supporter 130 via the clothing supporter 130.

However, a function of the clothing management apparatus 100 is not limited to the above-described heating, steaming, drying, dust removing functions, and an execution order of each function is not limited to the above example.

In FIG. 3, only one clothing supporter 130, sprayer 140, and circulator 150 have been illustrated, but there may be more than one clothing supporter 130, sprayer 140, and circulator 150.

In FIG. 3, the clothing support 130 is illustrated as having a shape of an ordinary hanger, but the shape of the clothing supporter 130 is not limited thereto. The clothing support 130 may have any shape that may support the garment.

Figure 4:
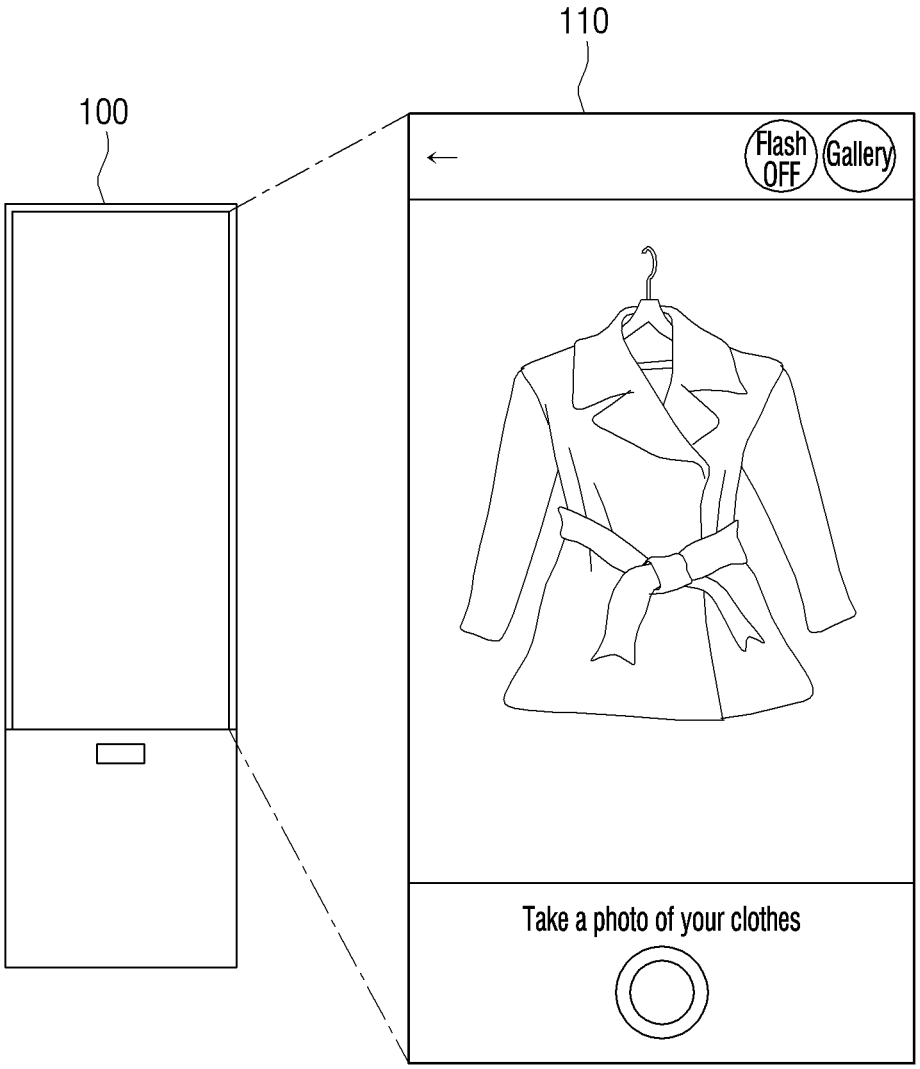
FIG. 4 is a schematic diagram illustrating an embodiment of obtaining an image including a garment according to an embodiment.

FIG. 4 is a schematic diagram illustrating an embodiment of obtaining an image including a garment according to an embodiment.

The processor 120 may be configured to control the capturing unit 170 to obtain an image including the garment. To be specific, the processor 120 may control a camera of the capturing unit 170 provided in the garment management apparatus 100 to obtain an image including the garment.

Referring to FIG. 4, the processor 120 may be configured to control the display 110 to display information to guide a user with respect to photographing of the garment. Here, when a user enters a command for photographing the garment, the processor 120 may be controlled to obtain an image including the garment via the camera.

An image including the garment may be obtained from an external device. Specifically, the processor 120 may communicate with an external device such as an external server, a smart phone, a PC, a camcorder, a camera, or the like, and obtain an image including the garment.

When an image including the garment is obtained, the processor 120 may determine the management necessity based on the state information of the garment.

Figure 5:
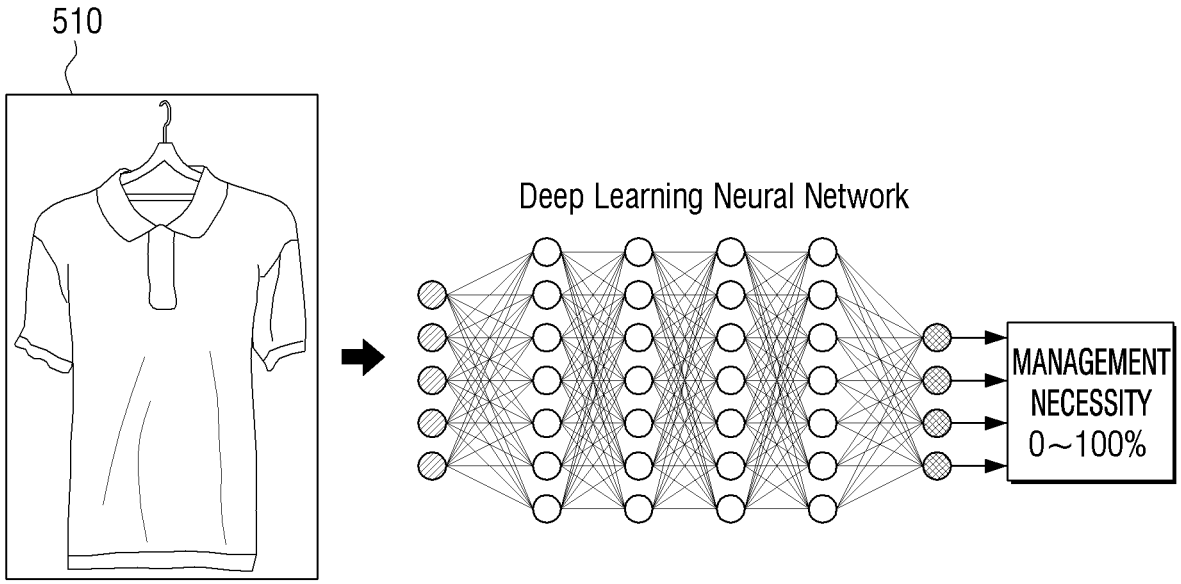
FIG. 5 is a schematic diagram for determining management necessity of a garment according to an embodiment.

FIG. 5 is a schematic diagram for determining management necessity of a garment according to an embodiment.

When an image including the garment is obtained, the processor 120 may determine the management necessity based on the state information of the garment.

Here, the management necessity is a numerical value that corresponds to how much management of the garment is necessary to process, clean, treat, or otherwise handle the garment. The garment which has relatively more wrinkles may have a higher degree of necessity as compared to the garment which has relatively fewer wrinkles. For example, the garment with many wrinkles may have 80% of the necessity of management, and the garment with fewer wrinkles may have 20% of the necessity of management.

Specifically, the processor 120 may determine the necessity for management of the garment included in the obtained image using the first AI model that is trained to determine the management necessity.

Here, the first AI model may be a model based on neural network. For example, the first AI model may be a model based on convolution neural network (CNN). This is merely an example, and the first AI model may include various models, such as deep neural network (DNN), recurrent neural network (RNN), bidirectional recurrent deep neural network (BRDNN), or the like.

The first AI model may receive a set of image data. Here, each of the plurality of images included in the image data set may be labeled with information based on the management necessity.

Specifically, based on the state information of the garment, such as the degree of crease in the garment, the degree of foreign matter stained on the garment, the degree of discoloration of the garment, or the like. Accordingly, each of the plurality of images may be labeled with information about different management necessities. For example, clothing with relatively large wrinkles may be labeled with higher management necessity than the garment with relatively fewer wrinkles.

The state information of the garment as described above is merely an example, and the state information of the garment may include various information, such as information on a shape of the garment, or the like.

The first AI model may be trained to determine the management necessity for the garment based on the state information of the garment. Specifically, the first AI model may extract feature data related to the state of the garment from each of the plurality of garments included in the image data set, and predict the management necessity based on the extracted feature data. The first AI model may be learned to determine the management necessity of the garment by comparing the predicted management necessity with the management necessity labeled for each image, and adjusting the weight according to the comparison result.

When a new image including the garment is included, the trained first AI model may determine the management necessity of the garment based on the state information of the garment included in the image. Specifically, the trained first AI model may extract feature data associated with the state information of the garment in the input image and determine the management necessity for the garment based on the extracted feature data.

Accordingly, as illustrated in FIG. 5, when an image 510 including the garment is obtained, the processor 120 may determine the management necessity of the garment included in the image 510 through the trained first AI model.

Specifically, when the image 510 including the garment is obtained, the processor 120 may input the corresponding image 510 as the input data for the first AI model, and when the management necessity is output from the first AI model, the processor 120 may determine the management necessity as the management necessity for the garment included in the image 510.

Although it has been described herein as determining the need for managing the garment based on the AI model, in the disclosure, the management necessity for the garment may be determined based on various algorithms. For example, the processor 120 may apply a contour detection algorithm to an image, and if there are many detected contours, the processor 120 may determine a high management necessity for the corresponding garment.

FIG. 6 is a diagram for determining a management mode applicable to a garment according to an embodiment.

The processor 120 may determine the management mode applicable to the garment, based on a characteristic of clothing. For example, the information on the fabric of the clothing may include a type of fiber included in the garment and information on a blending ratio.

To be specific, the processor 120 may obtain the fabric information of the garment included in the image by analyzing the obtained image through an AI model. For example, the AI model may be a model trained to determine the type of fiber and the blending ratio of the fiber included in the garment, based on the feature data extracted from the garment included in the image. The AI model may be a model based on the convolution neural network (CNN), but is not necessarily limited thereto.

The processor 120 may obtain the fabric information of the garment based on the label of the garment photographed by the camera. Specifically, the processor 120 may obtain the fabric information of the garment by recognizing characters indicating the type and the blending ratio of the fibers written on the label.

The processor 120 may obtain the fabric information by extracting the barcode information from the label, transmitting the extracted barcode information to an external server, and receiving the fabric information corresponding to the barcode information from the external server.

The method for obtaining the fabric information described above is merely an example, and the processor 120 may obtain the fabric information by various methods. For example, the fabric information may be obtained based on user input that is input through the inputter of the clothing management apparatus 100, or may be obtained from an external device, such as a smart phone.

The processor 120 may determine a management mode applicable to the garment based on the information on the fabric.

Specifically, the processor 120 may determine a representative fiber based on the types of the fiber and the blending ratio of fiber included in the fabric information, and identify the management mode to be applied to the garment based on the determined representative fiber.

The representative fiber may be a fiber having the highest blending ratio among different kinds of fibers included in the fabric information. For example, if the blending ratio of the leather fiber is the highest, the processor 120 may determine leather fiber as a representative fiber and determine a management mode applicable to the leather fiber.

Furthermore, the representative fiber may be determined by considering different weights of each fiber. For example, when the fibers included in the clothing are wool and nylon, the blend ratio of wool and nylon may be 40% and 60%, respectively, and the weight of wool may be set to 2, and the weight of nylon may be set to 1. Thereafter, the processor 120 may calculate the score of the wool as 80 that is obtained by multiplying the blending ratio 40% by weight 2, and calculate the score of the nylon as 60 that is obtained by multiplying the blending ratio 60% by weight 1. The processor 120 may determine the wool having the highest score as the representative fiber of the garment.

The representative fiber may be determined as the fiber that requires special management. For example, when silk fiber is included in the garment, the processor 120 may determine silk as the representative fiber of the garment.

The processor 120 may determine the management mode applicable to the garment based on the representative fiber.

The processor 120 may determine a management mode applicable to the garment, based on the table illustrated in FIG. 6. For example, when the representative fiber of the garment is synthetic leather, the processor 120 may determine management mode 19 as a management mode applicable to the garment.

In some cases, a plurality of representative fibers may be determined. For example, the processor 120 may determine a management mode applicable to the garment based on priority. Here, if the representative fibers are silk and nylon, referring to FIG. 6, the priority of the silk is 1, which is higher than the priority of the nylon, which is 4. As such, the processor 120 may determine the management mode 13 to a management mode applicable to the garment.

As illustrated in FIG. 6, there may be a plurality of management modes applicable depending on the representative fiber. In this case, the processor 120 may manage the garment based on the management mode selected by the user input.

FIG. 6 is merely an example of a table according to one embodiment, and types of fiber, priority, and the types of the applicable management mode are not limited thereto.

FIG. 7 is a diagram illustrating a method for determining management completeness of a garment expected when the garment is managed by the clothing management apparatus according to an embodiment.

When the management mode applicable to the garment is determined, the processor 120 may determine the expected management completeness, when the clothing is managed by the corresponding management mode.

Here, the management completeness means a value that indicates how much clothing management apparatus 100 achieves as a result of the garment being managed by the apparatus. For example, even in the same management mode, the garment that had relatively more wrinkles may have lower management completeness compared to the garment that had relatively fewer wrinkles.

Specifically, the processor 120 may determine the management completeness using a trained second AI model.

The trained second AI model may be a model trained to predict the management completeness of the garment when managing the garment in a specific management mode based on the management necessity of the garment. The second AI model may be a deep neural network (DNN), but is not limited thereto. For example, the second AI model may be a model that is trained to predict the management completeness of the garment, when the garment is managed in a specific management model based on the operation information of the sprayer and circulator of the clothing management apparatus 100 that may perform different operations depending on the management modes, based on the management necessity of the garment.

Accordingly, when the information on the management necessity of the garment and the information on the management mode applicable to the garment are input, the second AI model may predict and output the management completeness of the garment.

In particular, when there is a plurality of applicable management modes, the second AI model may predict and output the management completeness by the management modes.

Referring to FIG. 7, garment 1 has the management necessity of 100%, and management modes applicable thereto may be management mode A, management mode B, and management mode C. In this case, the processor 120 may input information regarding the management necessity and information regarding the applicable management mode to the second AI model as input data.

When the management completeness is output from the second AI model, the processor 120 may determine the management completeness that is output from the second AI model as the predicted management completeness of the garment included in the image.

Referring to FIG. 7, the processor 120, based on the management completeness output from the second AI model, may determine that garment 1 has the predicted management completeness of 50% when managed in management mode A, the predicted management completeness of 80% when managed in management mode B, and the predicted management completeness of 100% when managed in the management mode C. In addition, the processor 120 may determine that garment 2 has predicted management completeness of 60% when managed in the management mode A, and has the predicted management completeness of 90% when managed in the management mode B.

Meanwhile, although it has been described herein as predicting the management completeness of the garment based on an AI model, the management completeness of the garment may be predicted based on various algorithms. For example, the processor 120 may predict the management completeness of the garment based on the operation information of the sprayer and the circulator of the clothing management apparatus 100 different for each management mode. For example, the processor 120 may predict a high management completeness for a management mode with high operating intensity of the sprayer and the circulator, even if the garment has the same management necessity.

Figure 8:
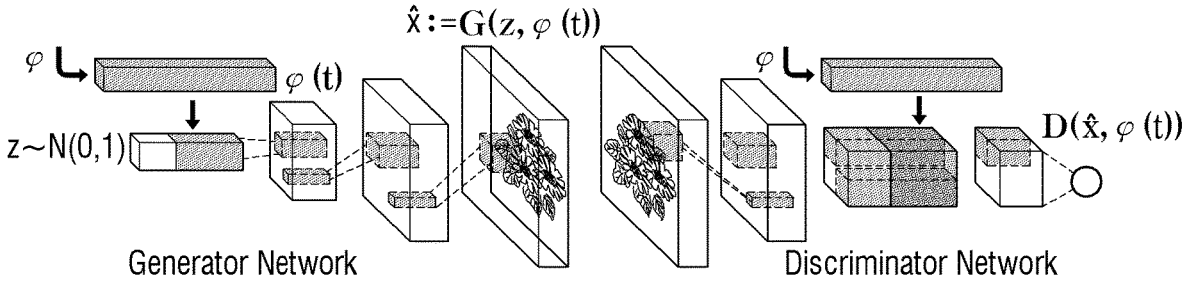
FIG. 8 is a schematic diagram illustrating a model for generating an image of a garment based on management completeness according to an embodiment.
Figure 9A:
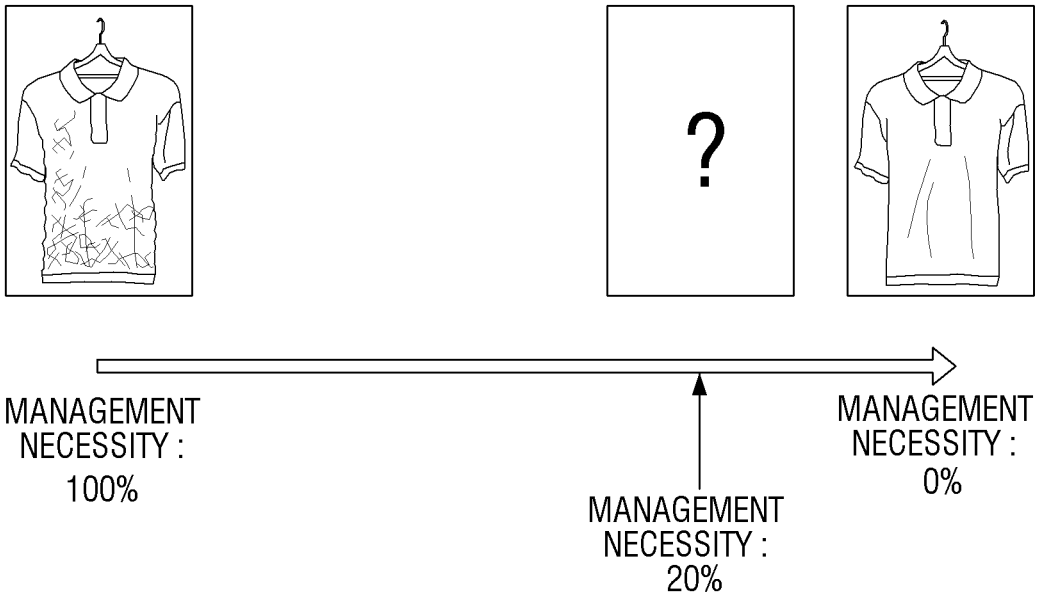
FIG. 9A is a schematic diagram illustrating a method for generating an image of a garment based on management completeness according to an embodiment.
Figure 9B:
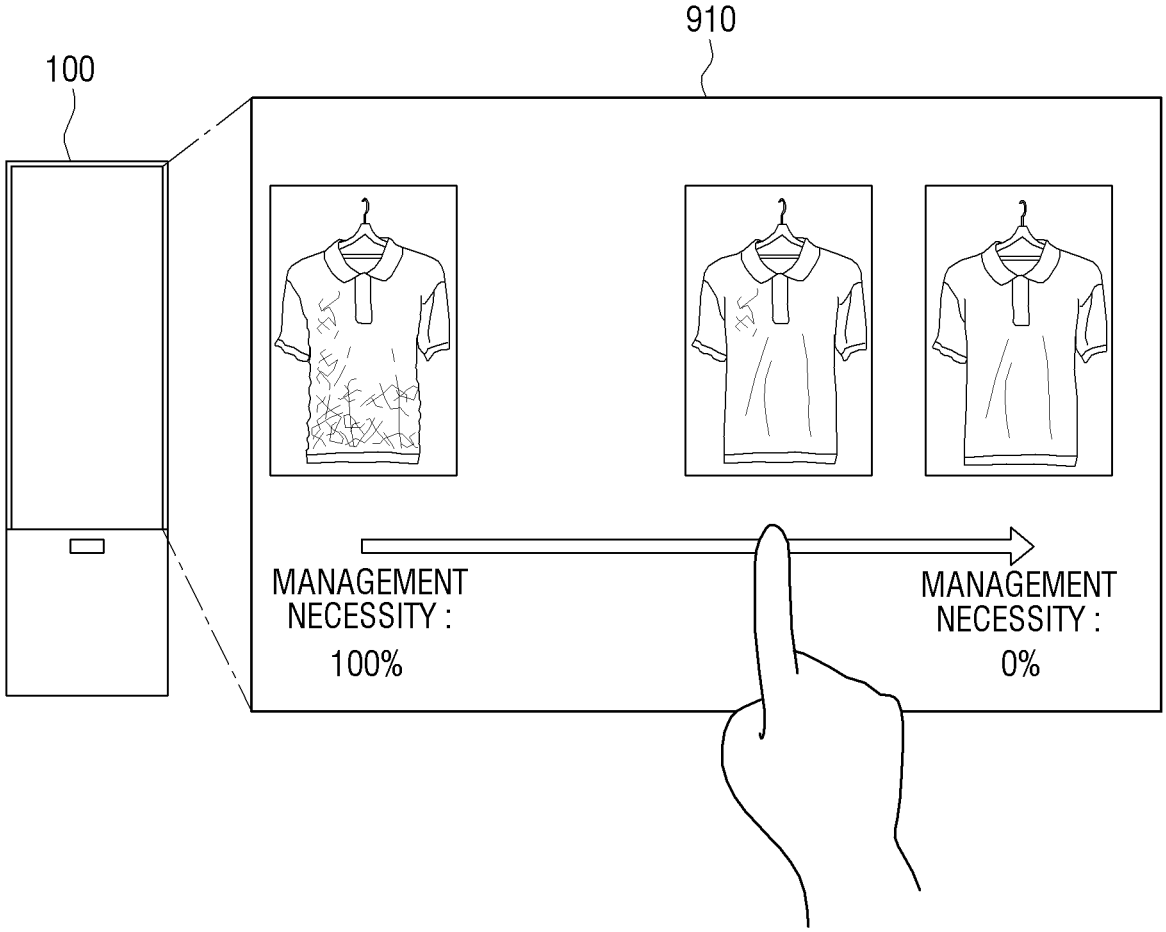
FIG. 9B is a schematic diagram of an embodiment of selecting management completeness according to an embodiment.

FIGS. 8, 9A, and 9B are schematic diagrams to describe a method for generating an image of a garment based on management completeness according to an embodiment.

The processor 120 may generate a predicted image of the garment, when the management of the garment is to be completed, based on the management completeness.

Specifically, the processor 120 may generate a predicted image of the garment upon completion of the management of the garment using a third AI model that is trained to generate an image of the garment based on the management completeness.

Here, the third AI model may be a generative adversarial network (GAN) model as illustrated in FIG. 8.

The GAN model is a model to generate a superficially authentic image to human observers through competition between two neural network models. Here, the third AI model may include a generator model and a discriminator model.

The generator model may generate an image of the garment corresponding to a specific management completeness with an image of the garment respectively corresponding to the plurality of management completeness as input data. The discriminator model may determine whether the corresponding image is an image generated by the generator model with the image generated by the generator model as the input data.

When it is determined that the image is not generated by the generator model, learning may be performed to determine that the image generated by the generator model is false.

When the discriminator model determines that the corresponding image is generated by the generator model, the generator model may be trained to generate an image similar to the image of the garment that more closely corresponds to a specific management completeness than the image that was generated.

Through repetition of learning, the third AI model may generate an image of the clothing that is similar to the state that management of the garment is actually completed.

For example, referring to FIG. 9A, when the management necessity for the garment included in the photographed image is 100%, and the management necessity of the garment that is predicted when managing the corresponding garment in a particular management mode is 20% (that is, the predicted management completeness is 80%), the third AI model may generate an image of the garment with a management completeness of 80% with the photographed image as input data.

In the meantime, the processor 120 may generate an image of the garment corresponding to the management completeness selected by the user.

For example, as illustrated in FIG. 9B, the processor 120 may display an image of which management necessity is 100%, an image of which management necessity is 0%, and a user interface UI 910 for selecting the management completeness.

In addition, when the management completeness is selected through the displayed UI 910, the processor 120 may generate and display an image of the garment corresponding to the selected management completeness through the third AI model. For example, if the management completeness of 80% is selected via the displayed UI 910, the processor 120 may generate and display an image of clothing of which management completeness is 80%. Here, the selection may be performed by a touch input or a drag input to the UI 910.

The method for selecting the management completeness as described above is merely an example, and the processor 120 may receive an input of the management completeness through various methods. For example, the processor 120 may display an input window capable of receiving the management completeness, and generate an image of the garment that corresponds to the management completeness based on the value input to the input window.

Further, the processor 120 may display information on the management mode corresponding to the selected management completeness on the display 110 when the management completeness is selected by the user.

For example, if the predicted management completeness is 80% when the garment is managed with the first management mode, and if the user selects 80% of the management completeness of the garment, the processor 120 may generate and display an image of the garment of which management completeness is 80% on an area of the display 110, and display the information on the first management mode on another area of the display 110. Here, the information about the management mode may include at least one of the types of the garment, the type of management mode to be applied to the corresponding garment, information on the time to be spent when managing in the first management mode or information on the power consumption when managing in the first management mode.

Here, although it has been described herein as generating an image corresponding to the management completeness of the garment based on the AI model, an image corresponding to the management completeness of the garment may be generated based on various methods. For example, the processor 120 may generate an image having a relatively small contour as the management completeness is higher, as an image corresponding to the management completeness.

According to an embodiment, the processor 120 may further include a neural network processing unit (NPU) for processing the AI model and a graphics processing unit (GPU) for generating an image corresponding to the management completeness. To be specific, the NPU may output the management completeness of the garment predicted when the management of the garment is completed using the AI model, and the GPU may generate an image of the garment corresponding to the predicted management completeness.

Figure 10:
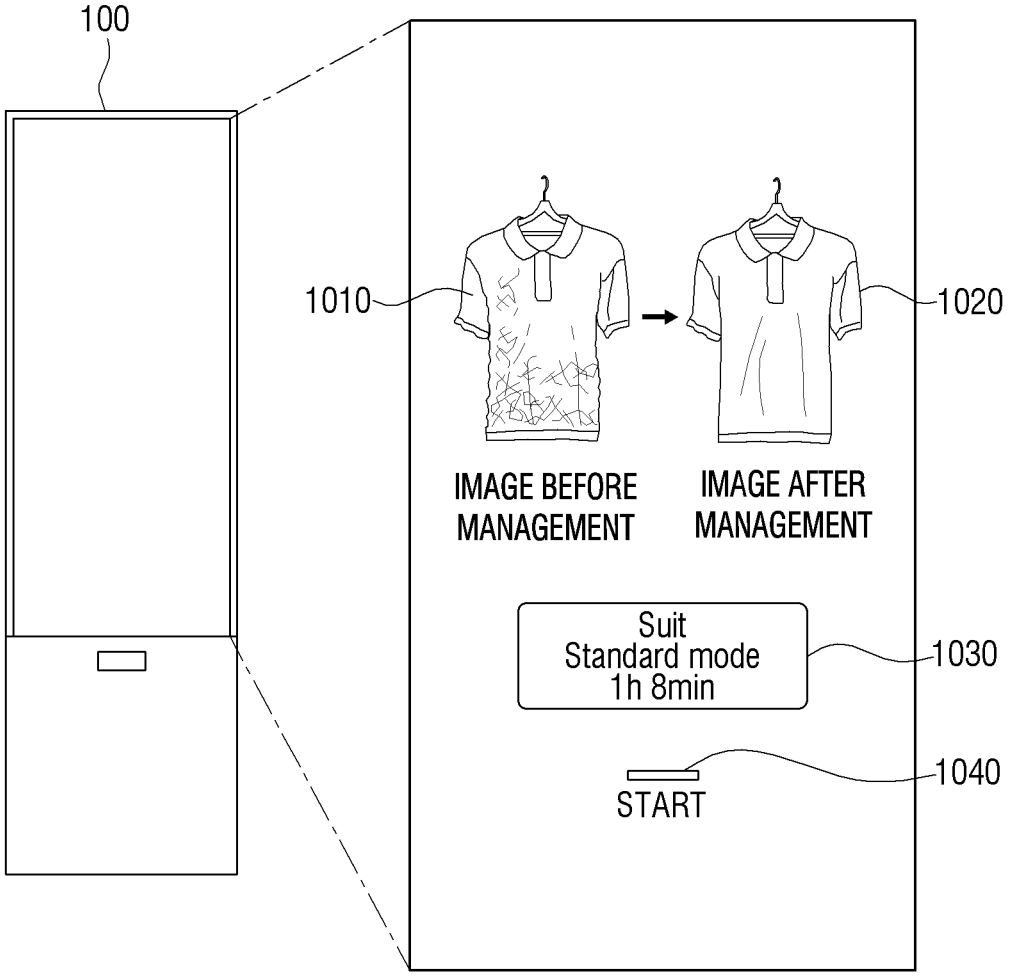
FIG. 10 is a schematic diagram illustrating an embodiment of displaying an image of a garment corresponding to the predicted management completeness according to an embodiment.

FIG. 10 is a schematic diagram illustrating embodiment of displaying an image of a garment corresponding to the predicted management completeness according to an embodiment.

According to an embodiment, when an image including the garment is obtained, the processor 120 may generate the management mode applicable to the garment and a predicted image of the garment when the garment is managed in the applicable management mode.

The processor 120 may generate information on the applicable management mode and the generated image on the display. Here, the information on the management mode may include the type of the garment, the type of the management mode applicable to the garment, information on the required time for managing the garment in the corresponding management mode.

For example, referring to FIG. 10, when the garment is a suit and the management mode applicable to the garment is a standard mode, information 1030 on the management mode including information that the garment is a suit, the applicable management mode is a standard mode, information on the expected time for managing the garment in the standard mode, and a predicted image 1020 of the garment after managing the garment in the standard mode may be displayed on the display.

Accordingly, a user may be able to visually identify the degree of completeness of the garment when managing the garment in a specific management mode.

As shown in FIG. 10, the processor 120 may control the display to display the information on the management mode 1030, a generated image 1020, and an obtained image 1010 together on the display.

Accordingly, the user may visually identify the degree of management of the garment by comparing an image before management and an image after management.

Thereafter, when a user command to manage the garment in an applicable management mode is input, the processor 120 may manage the garment in the applicable management mode.

Specifically, the processor 120 may manage the garment by identifying the operation information of the sprayer corresponding to the management mode applicable to the garment and the operation information of the circulator, among the operation information of the sprayer and the operation information of the circulator that are prestored in the memory for each management mode, and controlling the operations of the sprayer and the circulator according to the identified operation information.

The user command may be input by touching a UI 1040 for starting the clothing management as displayed on the display of FIG. 10, or may be input through various methods, such as input through a separately provided button or a remote control device, or the like.

Figure 11:
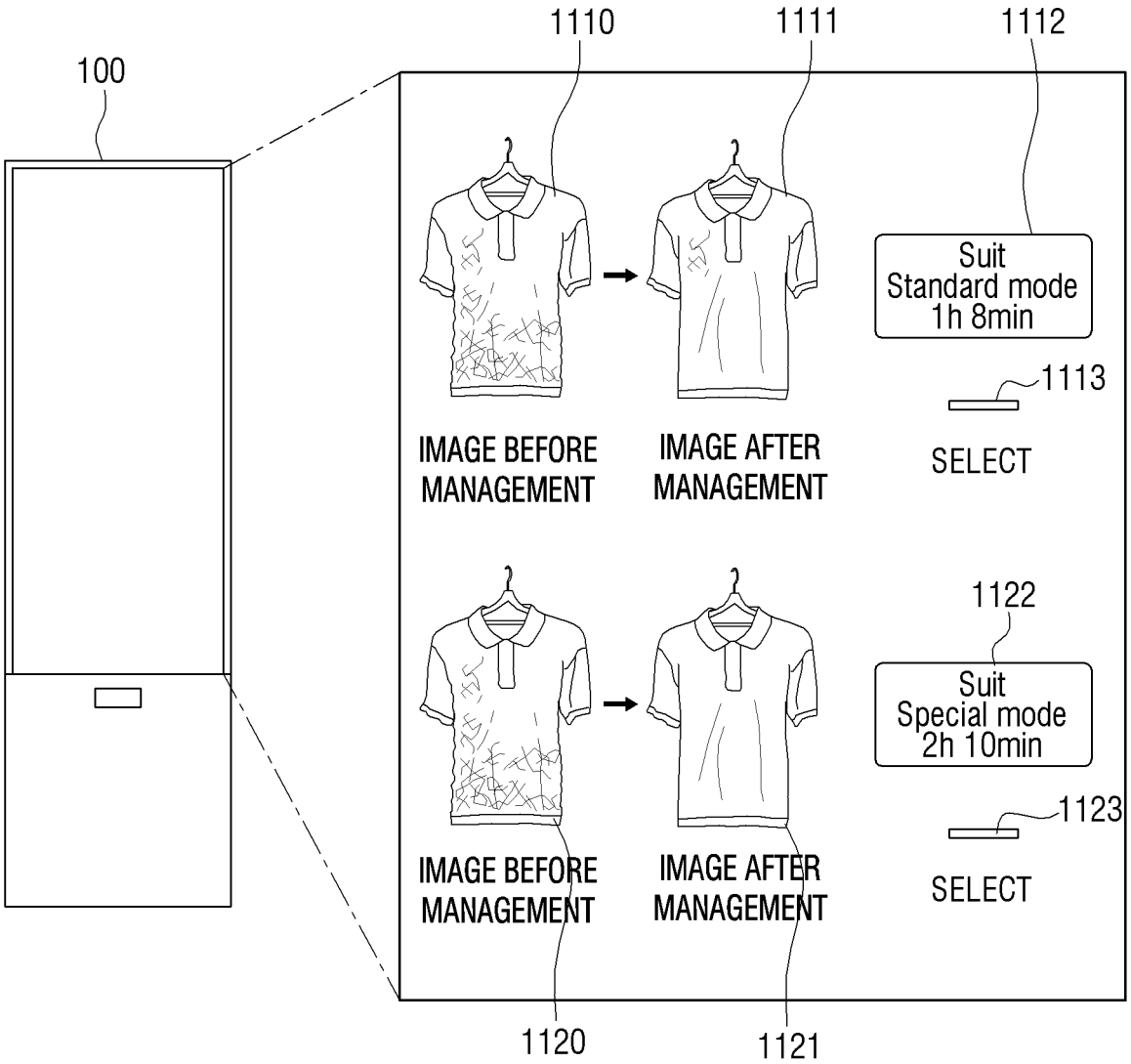
FIG. 11 is a schematic diagram illustrating an operation of the clothing management apparatus based on a plurality of applicable management modes according to an embodiment.

FIG. 11 is a schematic diagram illustrating an operation of the clothing management apparatus based on a plurality of applicable management modes according to an embodiment.

According to an embodiment, there may be a plurality of applicable management modes in accordance with the representative fiber. Accordingly, the processor 120 may generate a predicted image of the garment upon completion of the clothing management by the management modes.

Specifically, the processor 120 may predict the management completeness of the garment for each management mode, and generate a predicted image of the garment upon completion of the management of the garment based on different management modes.

For example, referring to FIG. 11, when the garment is a suit and the applicable management mode is a standard mode, an image 1111 of the suit is generated and displayed to show the predicted state of the garment after managing the garment in the standard mode. When the applicable management mode is a special mode, an image 1121 of the suit is generated and displayed to show the predicted state of the garment after managing the garment.

The processor 120 may control the display to display information on the management mode for each management mode and a generated image based on each management mode.

For example, referring to FIG. 11, the processor 120 may control the display to display an image 1110 obtained by the capturing unit, a predicted image 1111 after managing the garment in the standard mode and information 1112 on the standard mode in a region of the display. The processor 120 may also control the display to display the image 1120 obtained by the capturing unit, a predicted image 1121 of the garment after managing the garment in the special mode, and information 1122 on the special mode on another region of the display.

Thereafter, when a user inputs a command to select one management mode among a plurality of management modes, the processor 120 may manage the garment in the selected management mode.

Accordingly, by displaying the information on the management modes for each management mode and the respective generated images on the display, the user may actively determine a management mode of the garment based on the user's situation, or the like.

For example, if the user identifies through the images displayed on the display that the wrinkle relief of the garment is better than the user expected in any of the management modes, the user may select the mode that manages the garment in a shorter time, thereby determining the management mode suitable to the user's situation that the user needs to wear the garment urgently.

Figure 12:
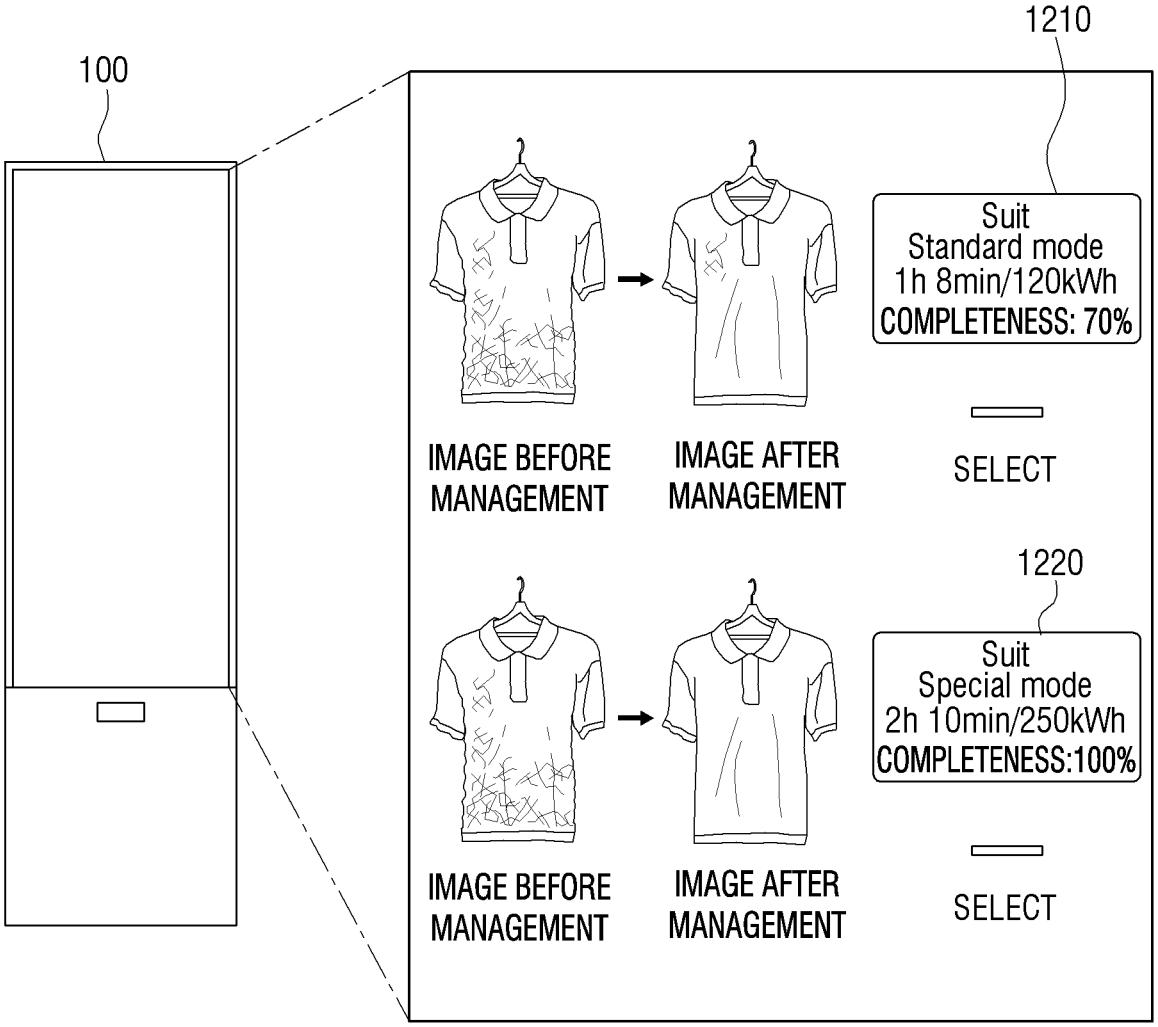
FIG. 12 is a schematic diagram illustrating information of the respective management modes displayed on the display according to an embodiment.

FIG. 12 is a schematic diagram illustrating information of the respective management modes displayed on the display according to an embodiment.

According to an embodiment, the processor 120 may control the display to display information including at least one of the types of the garment, the type of the management mode applicable to the corresponding garment and information on the expected for managing the garment in the corresponding management mode.

The processor 120 may control the display to display information further including at least one of the management completeness of the garment and the expected power consumption of the clothing management apparatus 100 based on different management modes.

When there is a plurality of applicable management modes, the processor 120 may control the display to display information including at least one of the types of the garment, the types of the management modes, the expected time for the management, the management completeness of the garment, and the expected power consumption of the clothing management apparatus 100 based on different management modes.

For example, referring to FIG. 12, when the garment is a suit and the applicable mode is a standard mode, the processor 120 may control the display to display information 1210 of the standard mode including the expected time for managing the garment in the standard mode, the expected power consumption of the clothing management apparatus 100 for managing the garment in the standard mode, and the management completeness of the garment that is predicted for managing the garment in the standard mode on one region of the display. Also, the processor 120 may control the display to display information 1220 of the special mode including the expected time for managing the garment in the special mode, the expected power consumption of the clothing management apparatus 100 for managing the garment in the special mode, and the management completeness of the garment that is predicted for managing the garment in the special mode in another region of the display.

As illustrated in FIG. 12, the processor 120 may control the display to display an image before clothing management and an image after clothing management along with the information of each management mode.

Accordingly, the user may actively determine the management mode of the clothing management apparatus considering different options.

For example, in a case that the management completeness is important, the user may control the clothing management apparatus to operate in a mode with high management completeness, and in a case that the time is important, the user may control the clothing management apparatus in a mode in which the clothing is managed in a short time, and in a case that the power consumption is important, the user may control the clothing management apparatus in a mode in which the clothing is managed with low power consumption.

Figure 13B:
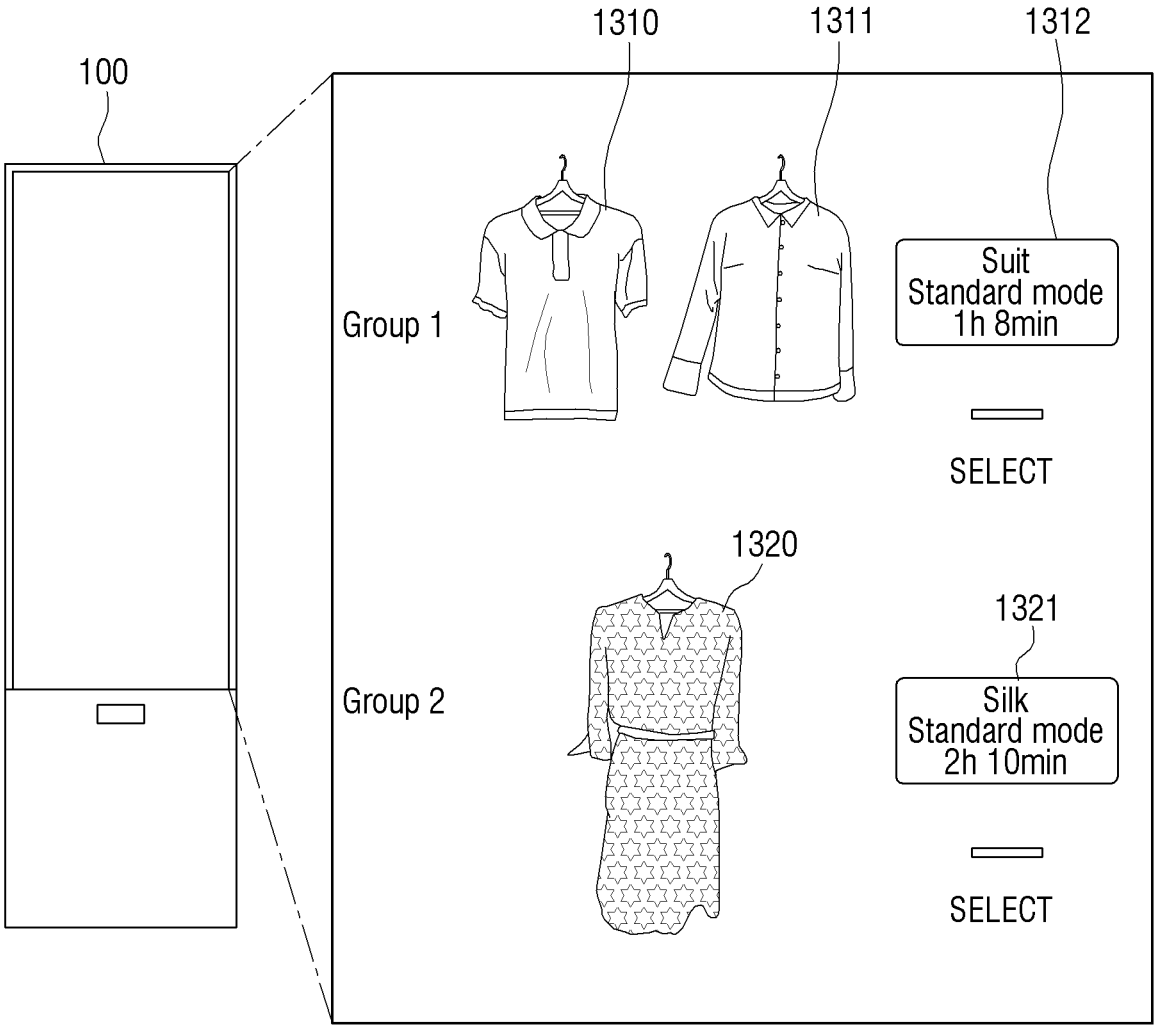
FIG. 13B is a schematic diagram illustrating an embodiment of displaying information to guide management of the garment by groups based on a plurality of garments according to an embodiment.

FIGS. 13A and 13B are diagrams illustrating an embodiment of displaying information to guide management of the garment by groups when there is a plurality of garments according to an embodiment.

The processor 120 may obtain a plurality of images including different garments. Here, the plurality of images may be obtained through a camera provided in the clothing management apparatus 100 or obtained through communication with an external electronic device, such as a smartphone, or the like.

The processor 120 may determine a management mode applicable to each of the plurality of garments based on the fabric information. For example, if an image including garment 1, an image including garment 2, and an image including garment 3 are obtained, the processor 120 may determine a management mode applicable to each garment based on the fabric information of each garment.

The processor 120 may classify a plurality of garments based on the applicable management mode and display information on the management mode applicable by the classified groups on the display.

Specifically, the processor 120 may classify the garment to which the same management mode is to be applied, among the plurality of the garments, and control the display to display the information on the management applicable for each of the classified group on the display.

For example, as illustrated in FIG. 13A, when the management mode applicable to garment 1 and garment 2 is the management mode A, and the management mode applicable to garment 3 is the management mode C, the processor 120 may classify garment 1 and garment 2 into a first group and classify garment 3 into a second group.

In addition, as illustrated in FIG. 13B, the processor 120 may control the display to display information 1312 related to the management mode A for the first group, and display information 1321 for the management mode C for the second group. Accordingly, the processor 120 may display predicted images 1310 and 1311 after managing the garments belonging to the first group in the management mode A, and a predicted image 1320 after managing the garment belonging to the second group in the management mode C.

As such, by grouping the garments that may be managed in the same group and providing the garments to a user, the user may efficiently manage a plurality of garments by groups.

In particular, by providing the user having insufficient knowledge about the clothing management method with information on the management mode applicable by groups, a problem of damaging the fabric due to managing a plurality of garments in the same management mode, in spite of the different types of fiber, may be prevented.

In classifying a plurality of garments, the number of the garment belonging to the group to which the same management is to be applied may be predetermined so that the number is less than or equal to a predetermined number.

Accordingly, the number of garments that can be managed at one time by the clothing management apparatus may limited to, for example, 5 garments. For example, when seven garments are classified into a group to which the same management mode is to be applied, the processor 120 may reclassify the seven garments into a group including two garments and a group including five garments.

Thereafter, when a user command to select a specific management mode is input, the processor 120 may control the clothing management apparatus 100 to operate in the corresponding management mode.

FIGS. 14A to 14E are charts showing an embodiment of displaying information to guide management of the garment by groups when there is a plurality of garments according to an embodiment.

When a plurality of images including different garments are obtained, the processor 120 may determine a management mode applicable to each of the plurality of garments based on fabric information.

For example, referring to FIG. 14A, the processor 120 may determine that the management modes applicable to garment 1 are management mode A and management B, and the management modes applicable to garment 2 are management mode A, management mode B, and management mode C, and the management modes applicable to garment 3 are management mode A and management mode C.

In addition, the processor 120 may determine the management completeness of the garment for each management mode. For example, referring to FIG. 14B, the processor 120 may identify that the predicted management completeness of garment 1 is 100% when managing in the management mode A, and that the predicted management completeness of garment 1 is 80% when managing in the management mode B. The processor 120 may determine that the predicted management completeness of garment 2 is 70% when managing in the management mode A, the predicted management completeness of garment 2 is 50% when managing in the management mode C, and the predicted management completeness of garment 2 is 100% when managing in the management mode C. The processor 120 may identify that the predicted management completeness of garment 3 is 90% when managing in the management mode A, and that the predicted management completeness of garment 3 is 100% when managing in the management mode C.

The processor 120 may classify a plurality of garments based on a plurality of criteria different from each other.

Specifically, the processor 120 may classify a plurality of garments based on at least one of management completeness, power consumption of the clothing management apparatus 100, expected time for managing the garments by the clothing management apparatus 100, and the number of managements performed by the clothing management apparatus 100.

If the criterion is the management completeness, the processor 120 may classify the plurality of garments such that the garment is managed with a relatively high management completeness, and if the criterion is the power consumption, the processor 120 may classify the plurality of garments such that the garment is managed with a relatively low power consumption, and if the criterion is the expected time, the processor 120 may classify the plurality of garments such that the garment is managed in a relatively short time, and if the criterion is the number of managements, the processor 120 may classify the plurality of garments such that the garment is managed for a minimum number of times. Here, the minimum number of times may refer to the number of times the management needs to be performed in order to achieve the management completeness desired by the user.

For example, referring to FIG. 14B, when the criterion is the management completeness, the processor 120 may classify garment 1 to the management mode A, garment 2 and garment 3 to the management mode C, so that garment 1, garment 2, and garment 3 may be managed with relatively high management completeness.

When the criterion is power consumption, the processor 120 may classify so that garment 1, garment 2, and garment 3 may be managed with relatively low power consumption. For example, referring to FIG. 14B, when the criterion is power consumption, the processor may classify garment 1 and garment 2 to management mode B and garment 3 to management mode A.

When the criterion is the amount of time to be spent, the processor 120 may classify garment 1 and garment 2 to management mode B, and garment 3 to management mode A so that garment 1, garment 2, and garment 3 may be managed within a relatively short time.

When the criterion is the number of times of management, the processor 120 may classify garment 1, garment 2, and garment 3 in the management mode A, so that the clothing management apparatus 100 manages garment 1, garment 2, and garment 3 with the minimum number of times.

Thereafter, the processor 120 may control the display to display information on the management mode to be applied to each of a plurality of garments on the display by criterion.

Figure 14C:
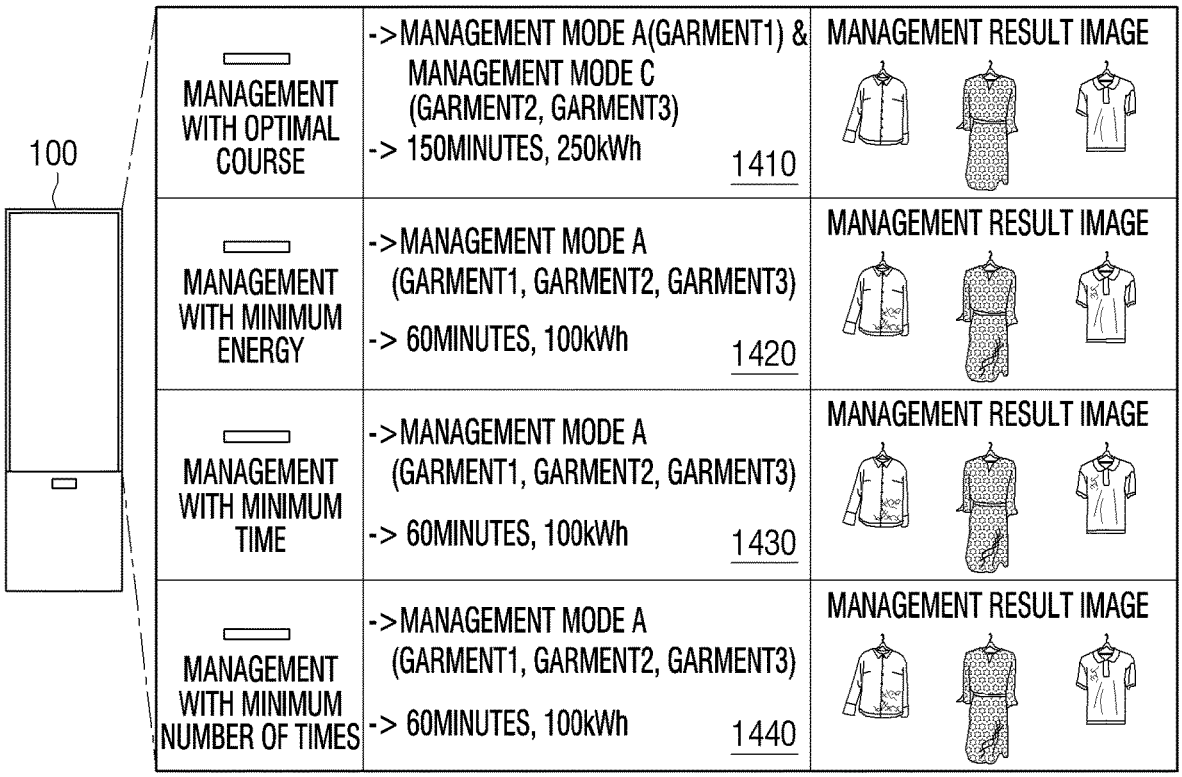
FIG. 14C is a schematic diagram illustrating a plurality of garments that are classified by various criteria according to an embodiment.

For example, referring to FIG. 14C, the processor 120 may control the display to display information 1410 on the management mode based on the management completeness, information 1420 on the management mode based on power consumption, information 1430 on the management mode based on expected time, and information 1440 on the management mode based on the number of times of the management.

The processor 120 may control the display to display a predicted image of garments upon management of the garments along with the information on the management mode by criteria.

If a user command to select a specific criterion is input, the processor 120 may manage a plurality of garments based on the corresponding criterion.

As such, by providing information on the management mode applicable to the plurality of garments by different criteria, the user may efficiently manage a plurality of garments based on the user's situation, or the like.

A method of clothing management according to a specific criterion is to manage garments with a plurality of management modes. The processor 120 may control the display to display information to guide the user in managing the garments by different management modes on the display.

Figure 14D:
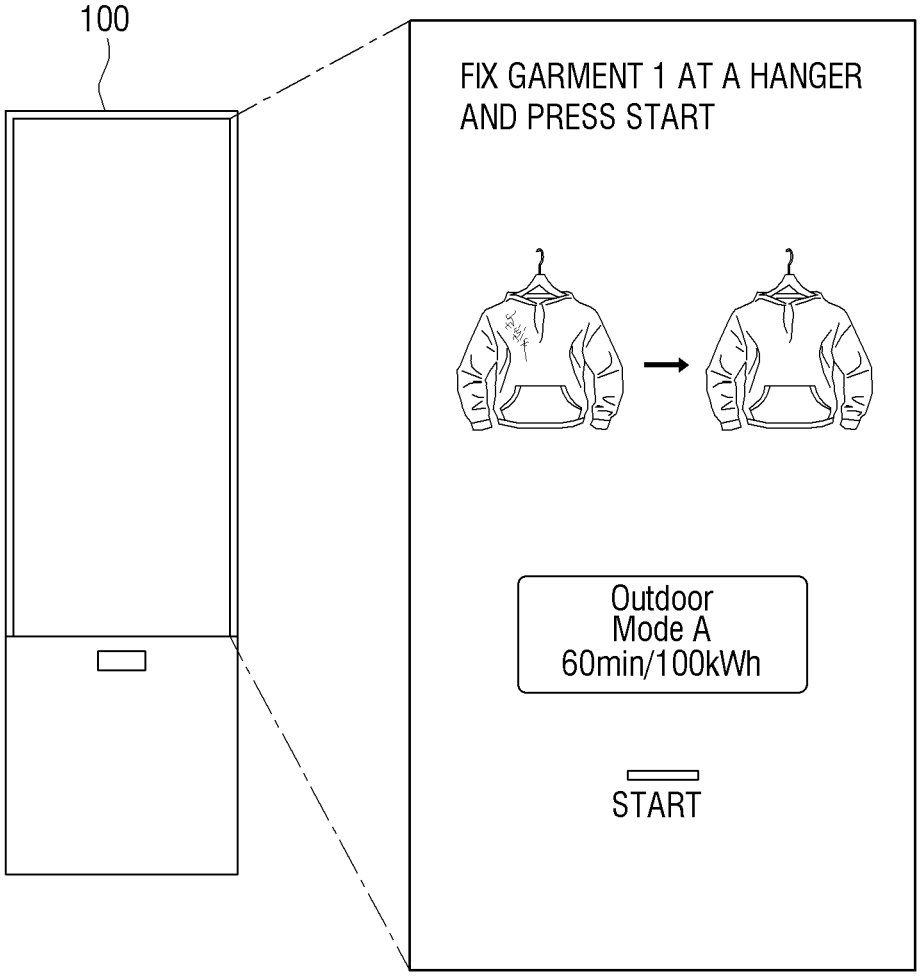
FIG. 14D is a schematic diagram illustrating an embodiment of displaying information to guide management of the garment by groups according to an embodiment.
Figure 14E:
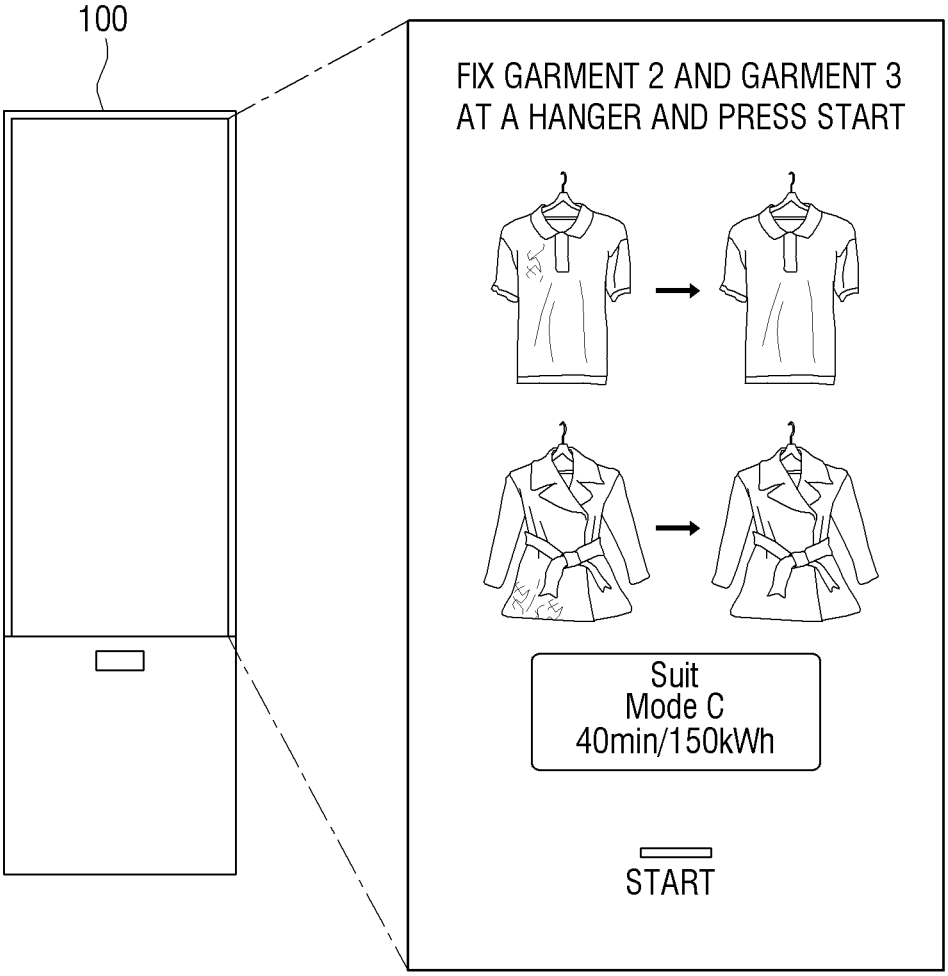
FIG. 14E is a schematic diagram illustrating an embodiment of displaying information to guide management of the garment by groups according to an embodiment.

For example, as shown in FIG. 14C, if a user inputs a command to optimally manage garments, that is, a user command to manage the garments to have a high management completeness, the processor 120 may control the display to display information about managing garment 1 with the management mode A as illustrated in FIG. 14D. If management of garment 1 is completed, the processor 120 may control the display to display information to proceed to manage garment 2 and garment 3 with the management mode C as illustrated in FIG. 14E.

Based on the criteria which are predetermined, information on the management mode applicable to the plurality of garments may be provided to a user.

Accordingly, the processor 120 may control the display to display a UI to receive a user command to set a classification standard for a plurality of garments through the display.

For example, the processor 120 may control the display to display a UI for receiving a user command to set at least one of the management completeness of garments, power consumption of the clothing management apparatus 100, expected time for managing garments by the clothing management apparatus 100, and the number of times of management of the clothing management apparatus 100 as a classification standard.

When the user command to select a specific criterion is received through the UI, the processor 120 may set the selected criterion as the classification criterion of the plurality of garments.

When a plurality of images including different garments are obtained, the processor 120 may classify a plurality of garments based on the preset criterion.

For example, if the management completeness of garments is set as the classification criterion, the processor 120 may predict the management completeness of each of the plurality of garments upon managing the plurality of garments in the applicable management modes, respectively, and classify the plurality of garments so that the plurality of garments may be managed with the relatively high management completeness.

That is, referring to FIG. 14B, the processor 120 may classify garment 1 to be managed with the management mode A, and garment 2 and garment 3 to be managed with the management mode C.

Similarly, if the predetermined criterion is power consumption, the processor 120 may determine the predicted power consumption of the clothing management apparatus 100 when each of the plurality of garments is managed in each applicable management mode, respectively, classify the plurality of garments such that the plurality of garments are managed using relatively low power consumption. If the predetermined criterion is a time consumption, the processor 120 may determine the predicted time consumption for managing the garments by the clothing management apparatus 100 when each of the plurality of garments is managed in an applicable management mode and classify the plurality of garments such that the plurality of garments are managed using a relatively low time consumption. If the preset criterion is the number of times of management, the processor 120 may classify the plurality of garments so that the plurality of garments are managed by the minimum number of managements.

When a user command to manage a plurality of garments is received according to the classified criteria, the processor 120 may control the clothing management apparatus 100 to manage a plurality of garments according to the classified criterion.

According to an embodiment, the processor 120 may classify a plurality of garments by considering the width of each of the plurality of garments.

Specifically, when the summed up value of the thickness of each of the plurality of clothes belonging to a group classified according to a specific criterion is greater than or equal to a preset value, the processor 120 may reclassify the plurality of garments belonging to the group to be less than the preset value.

That is, the clothing management apparatus 100 considers the size of the accommodating space, and may prevent a problem that a cloth may not be correctly managed, when the sum of the width of a plurality of garments disposed are beyond the accommodating capacity.

Figure 15:
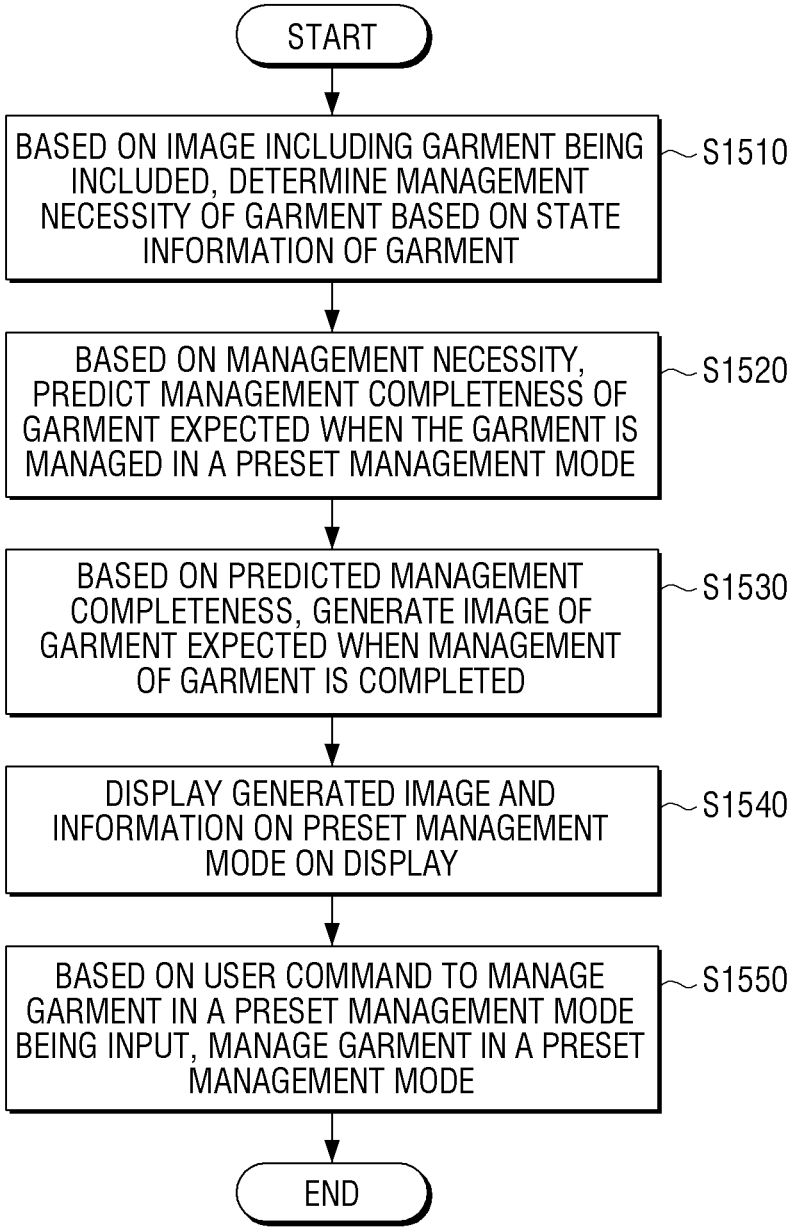
FIG. 15 is a flowchart to describe a method for managing the garment according to an embodiment.

FIG. 15 is a flowchart to describe a method for managing the garment according to an embodiment.

When an image including a garment is obtained, the clothing management apparatus 100 may identify the clothing management necessity based on the state information of a garment in step S1510.

According to an embodiment, the clothing management apparatus 100 may determine the management necessity of a garment included in an image through the first AI model. Here, the first AI model may be a model based on the convolution neural network (CNN), but is not limited thereto.

The management necessity is a value indicating the management necessity of a garment in a numerical value. A garment having relatively larger and more wrinkles may have a higher management necessity compared to a garment having a relatively smaller or fewer wrinkles.

The clothing management apparatus 100 may predict the management completeness of the garments when the garments are managed in the predetermined management mode in step S1520.

According to an embodiment, the clothing management apparatus 100 may use the second AI model to determine the management completeness of the garments. Here, the trained second AI model is a model that is trained to predict the management completeness of the garments when managing the garment in a specific management mode based on the management necessity. The model may be a deep neural network (DNN), but is not limited thereto.

The clothing management apparatus 100 may generate an expected management completeness, based on the predicted management completeness in step S1530.

According to an embodiment, the clothing management apparatus 100 may generate an expected image of the garment, when the management of the garment is completed, using the third AI model.

Here, the third AI model may be a generative adversarial network (GAN) model. The GAN model may generate an image of a garment which is similar to the state in which the management of the garment is actually completed, through the learning between the generator model and the discriminator model.

The clothing management apparatus 100 may display the generated image and the information on the preset management mode on the display in step S1540. Accordingly, the user may receive a visual feedback regarding how much the garment is managed when the clothing management is completed.

When a user command to manage a garment in the preset management mode is input, the clothing management apparatus 100 may manage the garment in the preset management mode in step S1550.

Figure 16:
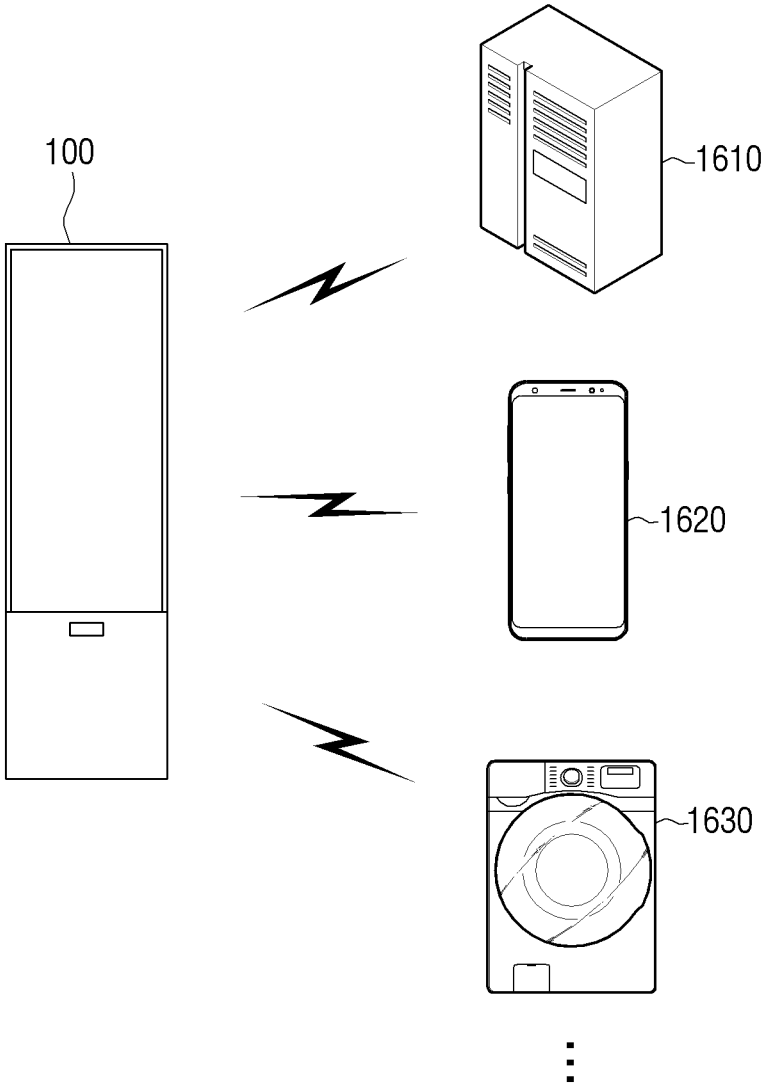
FIG. 16 is a schematic diagram illustrating a clothing management system according to an embodiment.

FIG. 16 is a schematic diagram illustrating a clothing management system according to an embodiment.

Hereinabove, it has been described that the clothing management apparatus 100 determines the management necessity and generates an expected image of the garment when management of the garment is completed, or the like.

However, the operations may be performed by an external electronic device, such as a server. As such, the clothing management apparatus 100 may receive information about an image and a particular management mode of the garment corresponding to a particular management necessity from an external electronic device, such as a server, and display information regarding the received image and management mode on a display.

For example, when an image including a garment is obtained, a server 1610 or a user terminal device 1620 may determine the management necessity of a garment through the AI model, and generate an expected image of the garment when the garment is managed in a specific management mode.

The clothing management apparatus 100 may receive the image of the garment generated by the server 1610 or the user terminal device 1620 and the information on the specific management mode, from the server 1610 or the user terminal device 1620, and display the received image and the information on the management mode on the display.

It has been described that an image including the garment is obtained through a camera of the clothing management apparatus 100, but an image including the garment may also be obtained from an external electronic device, such as a server, or the like.

In particular, an image that includes the garment may be received from an Internet of Things (IoT) device, such as a washing machine. In this case, when an image including the garment is received from the washing machine 1630, the clothing management apparatus 100 may determine the management necessity of the garment based on the state information of the garment including information on the degree of crease of the garment, and generate an expected image of the garment when managing the garment with a specific management mode. The generated image and information regarding the specific management mode may be displayed on the display.

According to an embodiment, a garment is managed in linkage with the IoT device such as the washing machine, and the garment may be managed more efficiently.

The methods according to various embodiments described herein may be performed by an electronic device equipped with a camera, such as a smart phone. The electronic device may determine the management necessity based on the state information of the garment once an image including the garment is acquired through the camera. The electronic device may predict the expected management completeness when managing the garment in a preset management mode based on the management necessity, and generate an expected image when the management of the garment is completed based on the predicted management completeness. The electronic device may display information about the generated image and the preset management mode on a display, and accordingly, the user may receive visual feedback of the degree of the garment being managed through the displayed image, and manage the garment based on the information about the displayed management mode.

The electronic device may display the generated image and the information on the preset management mode on the display of the electronic device, and display the information through the display of the clothing management apparatus 100.

Furthermore, the electronic device may transmit information on the generated image and the information on the preset management information to the clothing management apparatus 100, and the clothing management apparatus 100 may display the image and the information on the preset management information through the display of the clothing management apparatus 100, based on the information on the image received from the electronic device and the information on the preset management mode.

The methods according to various embodiments described herein may be implemented as software or an application formation that may be installed in an existing clothing management apparatus.

The methods according to various embodiments may be implemented by software upgrade of a related art clothing management apparatus, or hardware upgrade.

The various embodiments described herein may be implemented through an embedded server provided in the clothing management apparatus or a server outside the clothing management apparatus.

A non-transitory computer readable medium which stores a program for executing a method for controlling a clothing management apparatus according to an embodiment may be provided.

The non-transitory computer readable medium refers to a medium that stores data semi-permanently rather than storing data for a very short time, such as a register, a cache, a memory or etc., and is readable by an apparatus. In detail, the aforementioned various applications or programs may be stored in the non-transitory computer readable medium, for example, a compact disc (CD), a digital versatile disc (DVD), a hard disc, a Blu-ray disc, a universal serial bus (USB), a memory card, a read only memory (ROM), and the like.

The foregoing embodiments and advantages are merely examples and are not to be construed as limiting the disclosure. The disclosure can be readily applied to other types of apparatuses. Also, the description of the embodiments of the disclosure is intended to be illustrative, and not to limit the scope of the claims, and many alternatives, modifications, and variations will be apparent to those skilled in the art. While one or more embodiments have been described with reference to the accompanying drawings, it will be understood by those of ordinary skill in the art that various changes in form and details may be made therein without departing from the spirit and scope as defined by the claims and their equivalents.

What is claimed is:

1. A clothing management apparatus, comprising:

a display; and a processor configured to:

determine a management necessity of a garment in an image of the garment, using a first artificial intelligence AI model that is provided with the image as input data and is trained to determine the management necessity of the garment based on a state of the garment in the image, determine a management completeness that is expected when the garment is managed according to a management mode among a plurality of management modes, using a second AI model that is trained to predict the management completeness of the garment when the garment is managed according to the management mode based on the management necessity of the garment, generate an expected image of the garment that is expected when the garment is managed according to the management mode, using a third AI model that is trained to generate the expected image of the garment based on the management completeness, and control the display to display the expected image to a user.

2. The clothing management apparatus of claim 1, wherein the processor is further configured to:

based on information of fabric of the garment, determine the management mode among the plurality of management modes, predict the management completeness of the garment that is expected when the garment is managed in a first management mode and a second management mode, generate a first expected image of the garment managed in the first management mode and a second expected image of the garment managed in the second management mode, and control the display to display the first expected image and the second expected image and information on the first management mode and the second management mode on the display, and based on a user command selecting one of the first management mode and the second management mode being input, manage the garment in the selected management mode.

3. The clothing management apparatus of claim 2, wherein the information on the first management mode and the second management mode comprise information on management completeness of the garment that is predicted in the first and second management modes.

4. The clothing management apparatus of claim 2, wherein the information on the first management mode and the second management mode comprise information on power consumption of the clothing management apparatus that is expected when the garment is managed in the first management mode and the second management mode.

5. The clothing management apparatus of claim 2, wherein the information on the first management mode and the second management mode comprise information on expected times for managing the garment in the first management mode and the second management mode.

6. The clothing management apparatus of claim 1, wherein the processor is further configured to, based on a plurality of images including each of a plurality of garments, determine the management mode that is applicable to each of the plurality of garments based on fabric information of each of the plurality of garments, classify the plurality of garments into groups based on the management mode, and control the display to display information on the management mode that is determined by the classified groups.

7. The clothing management apparatus of claim 6, wherein the processor is further configured to classify the garment, among the plurality of garments, into one of the groups to which a same management mode is applied, and control the display to display information on the management mode by the classified groups.

8. The clothing management apparatus of claim 6, wherein the processor is further configured to predict management completeness of each of the plurality of garments that is expected when the plurality of garments are managed by each of the plurality of management modes, and classify the plurality of garments so that the plurality of garments are managed with a relatively high management completeness.

9. The clothing management apparatus of claim 6, wherein the processor is further configured to:

determine power consumption of the clothing management apparatus that is expected when the plurality of garments are managed in each of the plurality of management modes, and classify the plurality of garments so that the plurality of garments are managed with a relatively low power consumption, and determine an expected time for managing the plurality of garments in each of the plurality of management modes, and classify the plurality of garments so that the plurality of garments are managed in a relatively short time.

10. The clothing management apparatus of claim 6, wherein the processor is further configured to classify the plurality of garments so that the plurality of garments are managed in a minimum number of times to satisfy the management completeness input by the user.

11. The clothing management apparatus of claim 6, wherein the processor is further configured to classify the plurality of garments based on a plurality of different criteria and control the display to display information on the plurality of management modes that are applicable to each of the plurality of garments for each criterion.

12. The clothing management apparatus of claim 11, wherein the processor is further configured to classify the plurality of garments so that the plurality of garments are managed with a relatively higher management completeness, or classify the plurality of garments so that the plurality of garments are managed in a relatively shorter time.

13. A controlling method of a clothing management apparatus, the controlling method comprising:

determining a management necessity of a garment in an image of the garment using a first artificial intelligence AI model that is provided with the image as input data and is trained to determine the management necessity of the garment based on a state of the garment in the image;

determining a management completeness that is expected when the garment is managed according to a management mode among a plurality of management modes using a second AI model that is trained to predict the management completeness of the garment when the garment is managed according to the management mode based on the management necessity of the garment;

generating an expected image of the garment that is expected when the garment is managed according to the management mode, using a third AI model that is trained to generate the expected image of the garment based on the management completeness; and displaying the expected image to a user.

14. The controlling method of claim 13, further comprising:

based on information of fabric of the garment, determining the management mode among the plurality of management modes, predicting the management completeness of the garment that is expected when the garment is managed in a first management mode and a second management mode, generating a first expected image of the garment managed in the first management mode and a second expected image of the garment managed in the second management mode, and displaying the first expected image and the second expected image and information on the first management mode and the second management mode on the display, and based on a user command selecting one of the first management mode and the second management mode being input, managing the garment in the management mode.

15. The controlling method of claim 14, wherein the information on the first management mode and the second management mode comprise information on management completeness of the garment that is predicted in the first management mode and the second management mode.

16. The controlling method of claim 14, wherein the information on the first management mode and the second management mode comprise information on power consumption of the clothing management apparatus that is expected when the garment is managed in the first management mode and the second management mode.

17. The controlling method of claim 14, wherein the information on the first management mode and the second management mode comprise information on expected times for managing the garment by the first management mode and the second management mode.

18. A clothing management apparatus, comprising:

a display;

an image capturing device; and a processor configured to:

control the image capturing device to obtain an image of a garment;

determine an intensity of laundering to be applied to the garment in the image using a first artificial intelligence AI model that is provided with the image as input data and is trained to determine the intensity of laundering to be applied to the garment based on a condition of the garment in the image;

determine a laundering completeness that is estimated when the garment is laundered according to a laundering mode of the clothing management apparatus, using a second AI model that is trained to predict the laundering completeness that is estimated when the garment is laundered according to the laundering mode of the clothing management apparatus based on the intensity of laundering to be applied to the garment;

generate an estimated image of the garment illustrating a condition of the garment as if the garment is laundered according to the laundering mode, using a third AI model that is trained to generate the estimated image of the garment based on the laundering completeness; and control the display to display the estimated image to a user.

* * * * *